US009676510B2

(12) United States Patent
Learn

(10) Patent No.: US 9,676,510 B2
(45) Date of Patent: Jun. 13, 2017

(54) CONTAINER HAVING A DIVIDER, A LID, FOLDABLE SUPPORTS, AND INWARDLY FOLDING PANELS

(71) Applicant: PACTIV LLC, Lake Forest, IL (US)

(72) Inventor: Angela E. Learn, Gilbertsville, PA (US)

(73) Assignee: Pactiv LLC, Lake Forest, IL (US)

( * ) Notice: Subject to any disclaimer, the term of this patent is extended or adjusted under 35 U.S.C. 154(b) by 0 days.

(21) Appl. No.: 14/742,777

(22) Filed: Jun. 18, 2015

(65) Prior Publication Data

US 2015/0367980 A1 Dec. 24, 2015

Related U.S. Application Data

(60) Provisional application No. 62/014,012, filed on Jun. 18, 2014.

(51) Int. Cl.

| | |
|---|---|
| ***B65D 5/02*** | (2006.01) |
| ***B65D 5/44*** | (2006.01) |
| ***B65D 5/48*** | (2006.01) |

(52) U.S. Cl.

CPC ..... *B65D 5/0254* (2013.01); *B65D 5/44* (2013.01); *B65D 5/48014* (2013.01)

(58) Field of Classification Search

CPC ..... B65D 5/0254; B65D 2571/00487
USPC ..... 229/141, 404, 120.18, 111–114; 220/23.8, 23.86, 505, 522, 6, 23.2; 206/193

See application file for complete search history.

(56) References Cited

U.S. PATENT DOCUMENTS

| | | | | |
|---|---|---|---|---|
| 1,703,213 | A | 2/1929 | Shugart et al. | |
| 2,643,811 | A | 6/1953 | Bolding | |
| 3,182,885 | A * | 5/1965 | Maio | B65D 5/5016 206/418 |
| 4,413,769 | A * | 11/1983 | Michetti | B65D 83/0811 206/494 |
| 4,944,405 | A | 7/1990 | Buford et al. | |
| 5,465,834 | A * | 11/1995 | Sieber | B65D 5/48014 206/193 |
| 5,738,272 | A | 4/1998 | Anchor et al. | |
| 8,584,884 | B2 | 11/2013 | Learn et al. | |

OTHER PUBLICATIONS

International Search Report dated Sep. 8, 2015 in International Application No. PCT/US2015/036342.

* cited by examiner

*Primary Examiner* — Christopher Demeree
(74) *Attorney, Agent, or Firm* — Baker Botts L.L.P.

(57) ABSTRACT

Unitary blank can include a first body portion, a second body portion joined to the first, a third body portion joined to the second, and a fourth body portion joined to the third. A first flap can extend from the fourth body portion and can have a first engagement portion adjacent to the fourth body portion, a second engagement portion opposite the fourth body portion, and a central portion defined therebetween. At least one inwardly folding panel can be disposed between adjacent body portions along a corresponding body fold line. First, second, third, and fourth base portions can extend from the first, second, third, and fourth body portion, respectively. Food containers and methods are also provided.

22 Claims, 26 Drawing Sheets

CONTAINER HAVING A DIVIDER, A LID, FOLDABLE SUPPORTS, AND INWARDLY FOLDING PANELS

PRIORITY CLAIM

This application claims priority to U.S. Provisional Application Ser. No. 62/014,012, filed Jun. 18, 2014, the contents of which is incorporated herein by reference in its entirety.

BACKGROUND

Field of the Disclosed Subject Matter

The present disclosed subject matter relates to a food container for packaging and serving of food items, such as chicken nuggets, french fries, and other bite-size foods. The present disclosed subject matter includes a container for holding food items that can be configured to securely fit into a standard car cup holder.

Description of Related Art

A variety of food items, such as french fries, onion rings, chicken nuggets, popcorn shrimp, and other bite-size foods, are often served from small paperboard containers. These food containers can be pouch-shaped, such as commonly used for french fries, or can be box-shaped and have a lid to contain the food item, such as deli items or the like.

Containers of this type can be formed of foldable paperboard, and can be a single-use product used in large quantities. As such, it can be desirable to reduce or minimize the costs associated with materials, manufacturing, storage, shipping, manner of use, and the like, of such containers.

It can also be desirable to provide a food container with a divider therein to separate the interior of the container into more than one portion or compartment. In this manner, each portion or compartment can contain a serving of a different product, with the different products separated by the divider.

A number of food products are often dipped into sauces or condiments, such as ketchup, mustard, or mayonnaise, before consumption. Many food service establishments provide bulk containers of these condiments and small paper or plastic cups into which the condiment can be dispensed. Alternatively, the condiments may come prepackaged in a sealed container.

If the food product is consumed by a person while seated at a table, the condiment containers can be placed on the table. However, if a person wishes to walk with the container or to eat the food product while driving a vehicle, the use of a condiment becomes more difficult. Both the condiment cup and food container must be held in one hand while the other hand grasps an item of food and dips it in the condiment.

It is also known that certain food items, such as fried chicken, emit moisture or water vapor along with latent heat stored in the food due to cooking and heating. Some of this latent heat and moisture can condense on and be reabsorbed by the food item itself, making the food item soggy, less crispy, and tough to eat. Also, the water vapor can condense on the interior surfaces of the container and drip down towards the bottom of the container for the bottom pieces of the food item to absorb. If air circulation adjacent to and around the food item is poor, the water reabsorption by the food item increases since the latent heat and the resultant water vapor is further prevented from circulating away from the food item. Further, if air from inside the container not allowed to be exchanged with the air from outside the container, condensation of the water vapor on the inside of the container is more likely. Even if a small amount of water vapor escapes from the food item and condenses, or is prevented from circulating away from the food item, this amount can be enough to make the food item undesirable.

It therefore can be desirable to provide a food container with a condiment holder that is integrally formed with a food container and capable of securely retaining a condiment receptacle even when the food container is carried or jarred, along with a secure lid to contain the food item and keep the food item warm yet allow sufficient venting to prevent the food item from becoming soggy or otherwise undesirable. It also can be desirable to provide a food container configured to securely fit into a standard car cup holder.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a unitary blank for forming a food container. The unitary blank can include first, second, third, and fourth body portions. A first body portion can have a first base edge at least partially defined by a first body portion base fold line. A second body portion can be joined to the first body portion by a first body fold line and can have a second base edge at least partially defined by a second body portion base fold line. A third body portion can be joined to the second body portion by a second body fold line and can have a third base edge at least partially defined by a third body portion base fold line. A fourth body portion can be joined to the third body portion by a third body fold line and can have a fourth base edge at least partially defined by a fourth body portion base fold line. A first flap can extend from the fourth body portion opposite the third body fold line and can be defined by a first flap fold line. The first flap can have a first engagement portion adjacent to the fourth body portion, which can be defined by a first flap engagement fold line. A second engagement portion of the first flap can be opposite the fourth body portion and can be defined by a second flap engagement fold line. A central portion can be defined between the first flap engagement fold line and the second flap engagement fold line. The first engagement portion can be disposed to engage the first body portion when the first flap is folded along the first flap line. The central portion can be disposed to form an interior dividing wall when the central portion is folded along the first flap engagement line. The second engagement portion can be disposed to engage the third body portion when the second engagement portion is folded along the second flap engagement fold line. At least one inwardly folding panel can be disposed between adjacent body portions along a corresponding body fold line. A first base portion can extend from the first body portion base edge. A second base portion can extend from the second body portion base edge. A third base portion can extend from the third body portion base edge. A fourth base portion can extend from the fourth body portion base edge. The second base portion and the fourth base portion each can have an engagement feature disposed thereon. The base portions can form a base when joined together.

For purpose of illustration and not limitation, a second flap can extend from the second body portion opposite the second body portion base edge and can be defined by a second flap fold line. The second flap can have a first foldable support formed therein. The first foldable support can be joined to the second flap by a first foldable support flap fold line. Additionally, the first foldable support can be joined to the second body portion by a first foldable support body fold line.

As embodied herein, a third flap can extend from the fourth body portion opposite the fourth body portion base edge and can be defined by a third flap fold line. The third flap can have a second foldable support formed therein. The second foldable support can be joined to the third flap by a second foldable support flap fold line. Additionally, the second foldable support can be joined to the fourth body portion by a second foldable support body fold line.

Additionally or alternatively, a fourth flap can extend from the first body portion opposite the first body portion base edge and can be defined by a fourth flap fold line. The fourth flap can be moveable between an open position and a closed position. The fourth flap can include a tab to engage the third body portion when in the closed position.

As embodied herein, the fourth flap can have a foldable support formed therein. The foldable support can be joined to the fourth flap by a foldable support flap fold line. Additionally, the foldable support can be joined to the first body portion by a foldable support body fold line.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1:
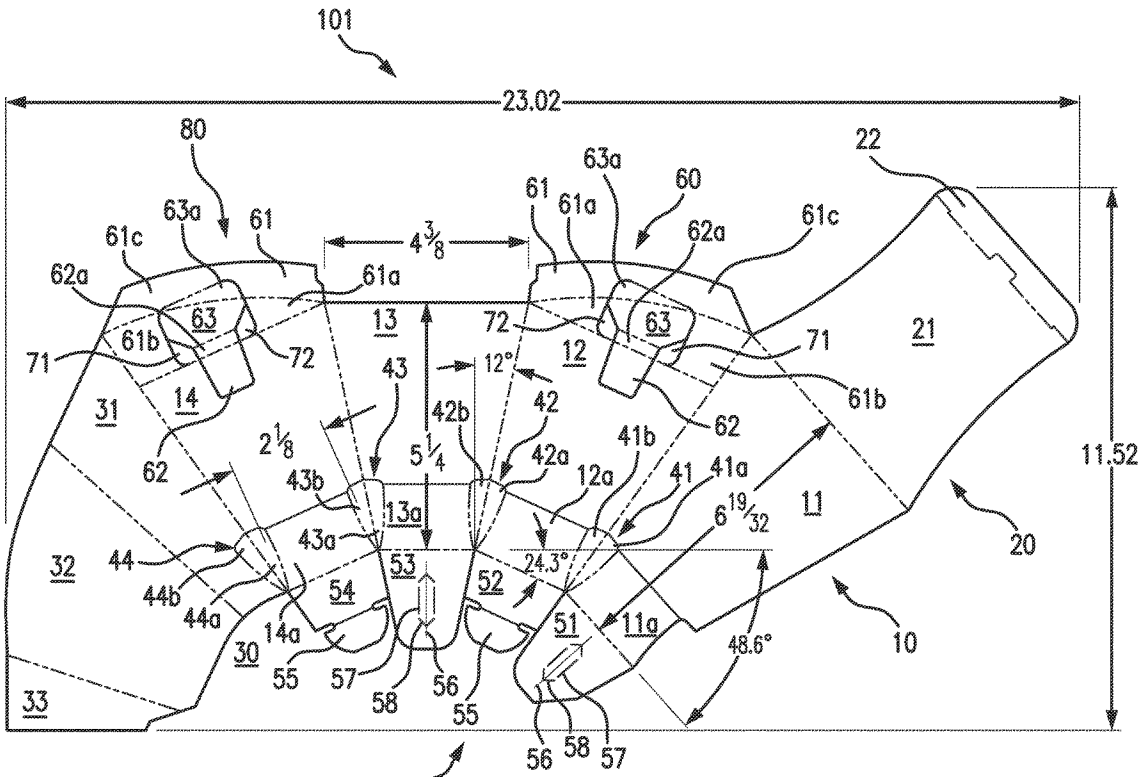
FIG. 1 is a plan view of an exemplary embodiment of a unitary blank for forming a food container in accordance with the disclosed subject matter.

Reference will now be made in detail to the various exemplary embodiments of the disclosed subject matter, exemplary embodiments of which are illustrated in the accompanying drawings. The structure and corresponding methods of making and operation of the disclosed subject matter will be described in conjunction with the detailed description of the system.

The apparatus and methods presented herein may be used for transport of food items and other perishable and non-perishable products. The disclosed subject matter is particularly suited for packaging and serving of food items, wherein the container can convert between a closed position, in which the contents of the container are enclosed, and an open configuration, in which the container includes a support for a receptacle containing a condiment and allows for consumption of the food product and dipping of the food product into the condiment. Exemplary containers having a foldable support and lid can be found, for example, in U.S. Pat. No. 8,584,884, which is incorporated by reference herein in its entirety. Additionally, the container can allow for venting of the food items in the closed position. Furthermore, the container can have a flap to form an interior dividing wall within the interior of the container. The container can also have inwardly folding panels to securely fit into a standard car cup holder.

In accordance with the disclosed subject matter herein, a unitary blank for forming a food container is provided. The unitary blank generally can include first, second, third, and fourth body portions. A first body portion can have a first base edge at least partially defined by a first body portion base fold line. A second body portion can be joined to the first body portion by a first body fold line and can have a second base edge at least partially defined by a second body portion base fold line. A third body portion can be joined to the second body portion by a second body fold line and can have a third base edge at least partially defined by a third body portion base fold line. A fourth body portion can be joined to the third body portion by a third body fold line and can have a fourth base edge at least partially defined by a fourth body portion base fold line. A first flap can extend from the fourth body portion opposite the third body fold line and can be defined by a first flap fold line. The first flap can have a first engagement portion adjacent to the fourth body portion, which can be defined by a first flap engagement fold line. A second engagement portion of the first flap can be opposite the fourth body portion and can be defined by a second flap engagement fold line. A central portion can be defined between the first flap engagement fold line and the second flap engagement fold line. The first engagement portion can be disposed to engage the first body portion when the first flap is folded along the first flap line. The central portion can be disposed to form an interior dividing wall when the central portion is folded along the first flap engagement line. The second engagement portion can be disposed to engage the third body portion when the second engagement portion is folded along the second flap engagement fold line. At least one inwardly folding panel can be disposed between adjacent body portions along a corresponding body fold line. A first base portion can extend from the first body portion base edge. A second base portion can extend from the second body portion base edge. A third base portion can extend from the third body portion base edge. A fourth base portion can extend from the fourth body portion base edge. The second base portion and the fourth base portion each can have an engagement feature disposed thereon. The base portions can form a base when joined together. A container formed from a unitary blank is also provided.

Figure 2:
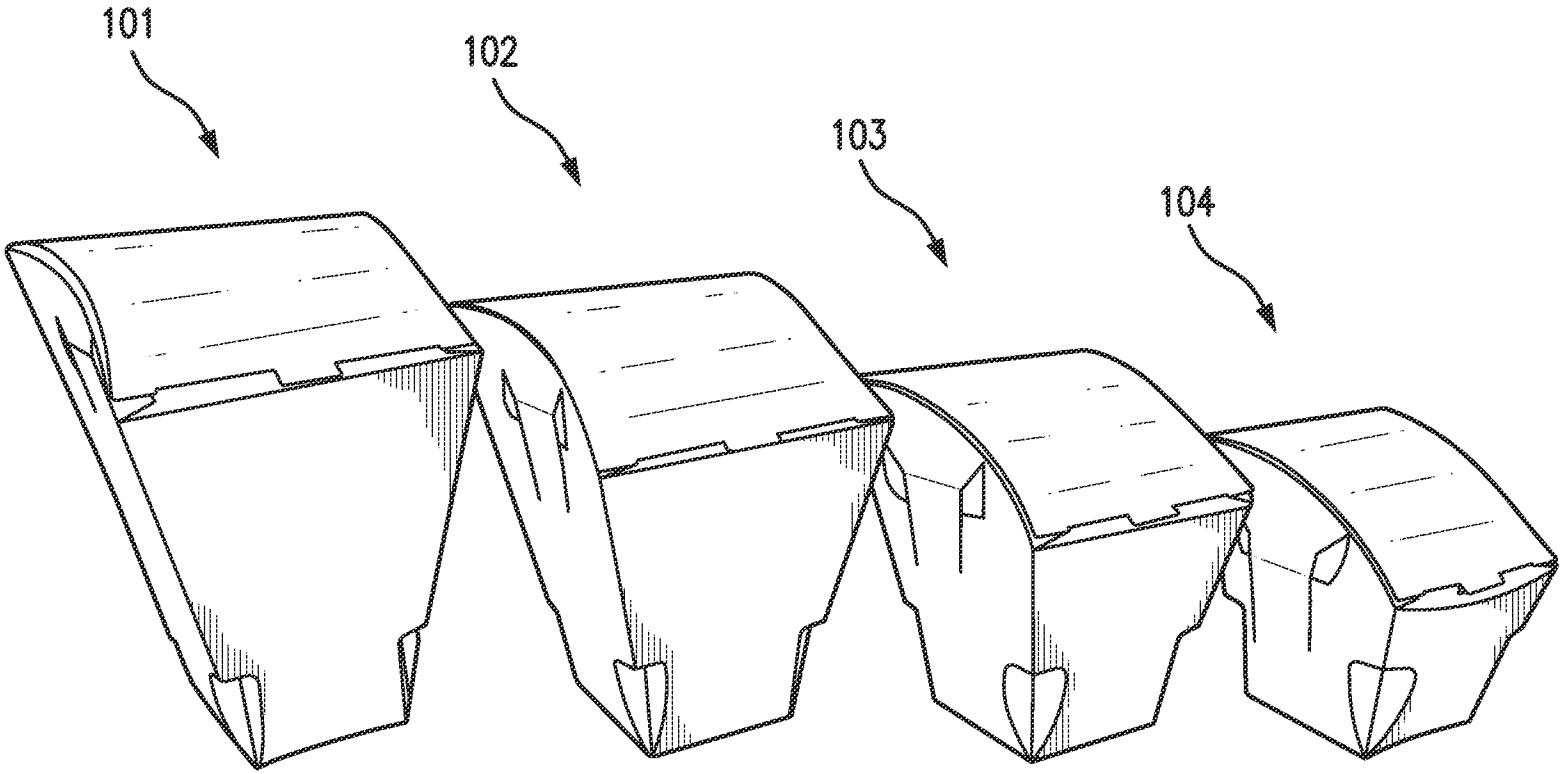
FIG. 2 is a perspective view of exemplary embodiments of containers having different sizes and configurations in accordance with the disclosed subject matter.
Figure 3:
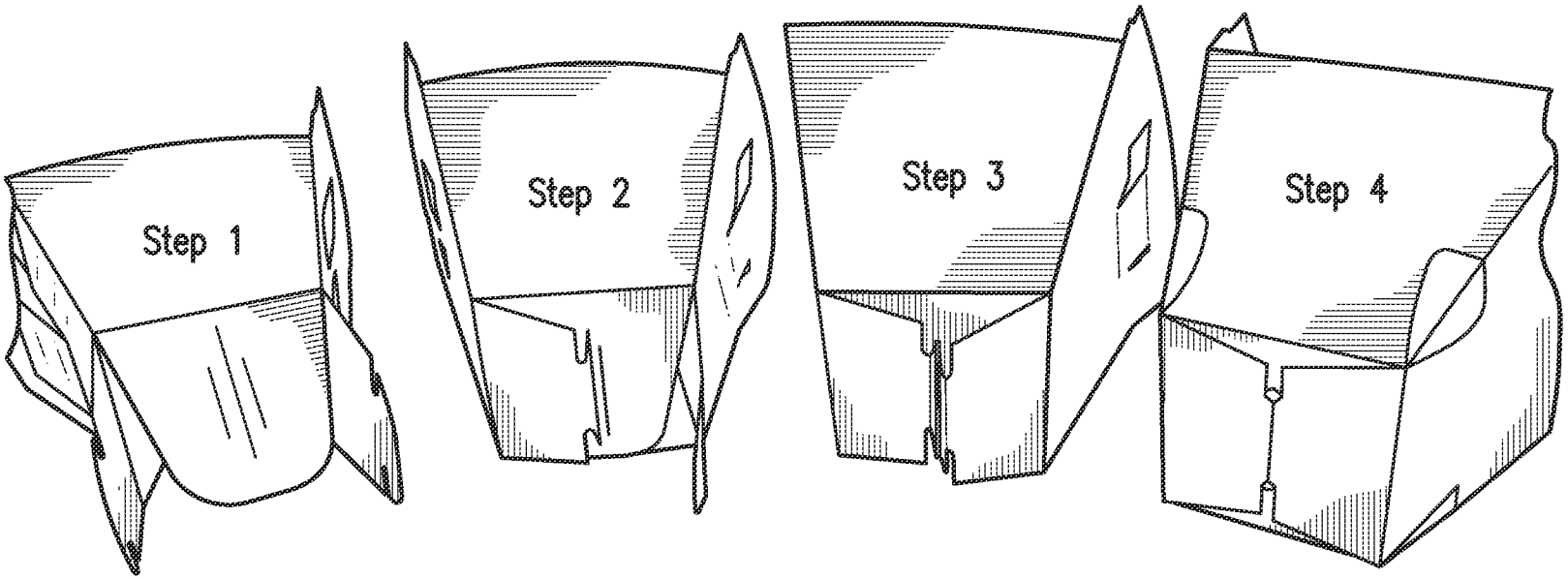
FIG. 3 is a perspective view of an exemplary method of forming a base of an exemplary embodiment of a container from the unitary blank of FIG. 1 in accordance with the disclosed subject matter.
Figure 4:
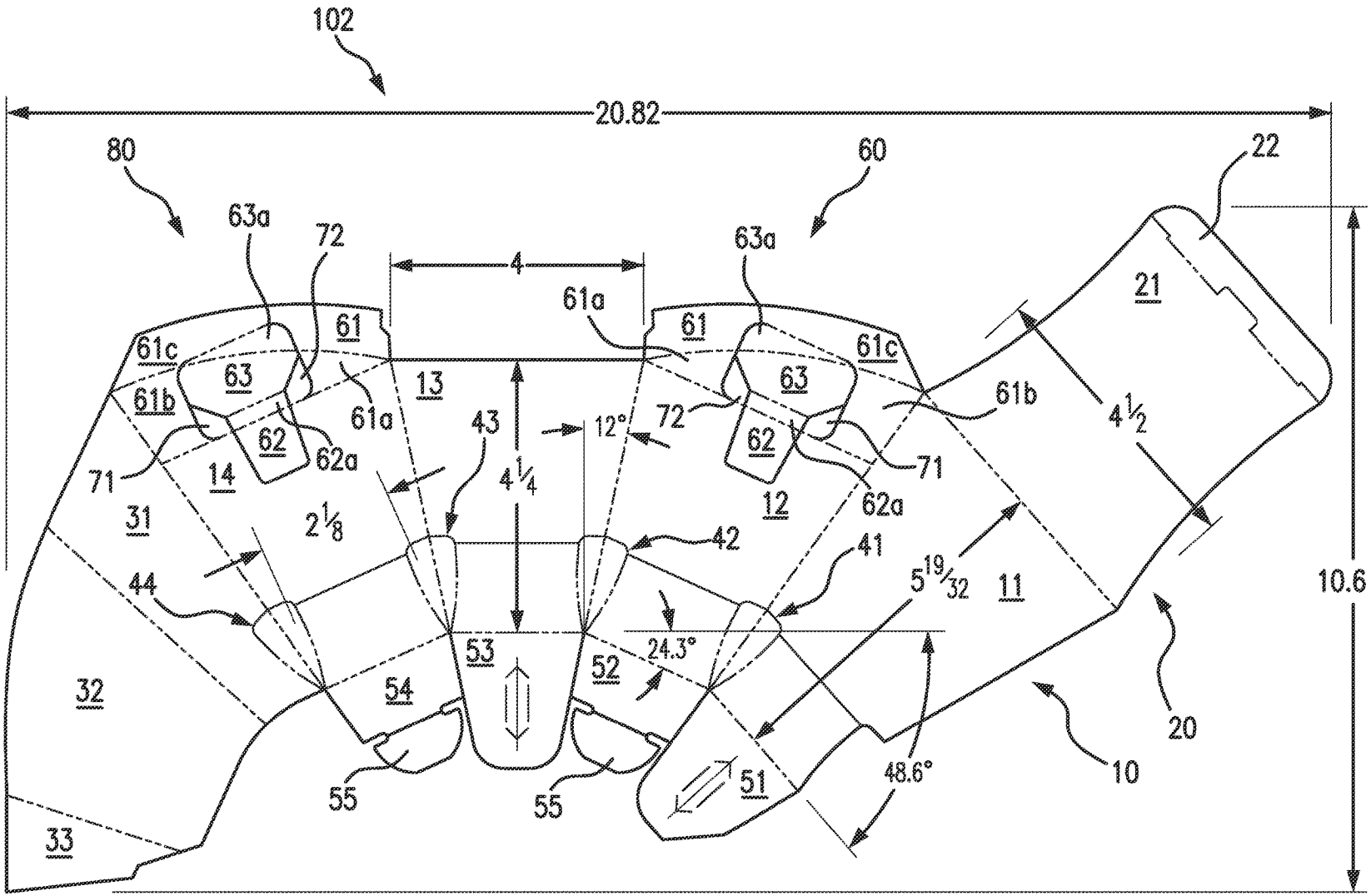
FIG. 4 is a plan view of another embodiment of a unitary blank for forming a food container in accordance with the disclosed subject matter.
Figure 5:
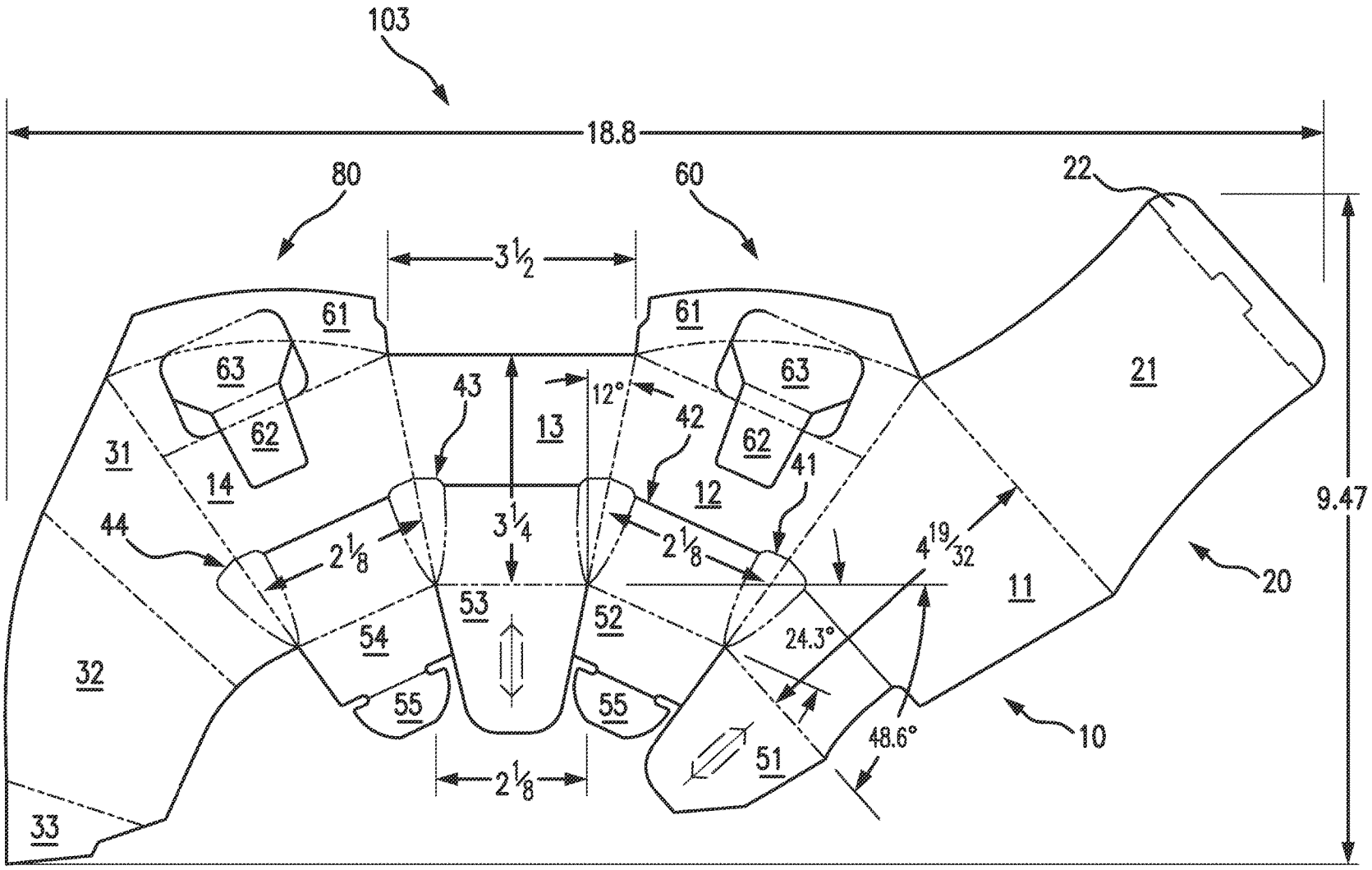
FIG. 5 is a plan view of another embodiment of a unitary blank for forming a food container in accordance with the disclosed subject matter.
Figure 6:
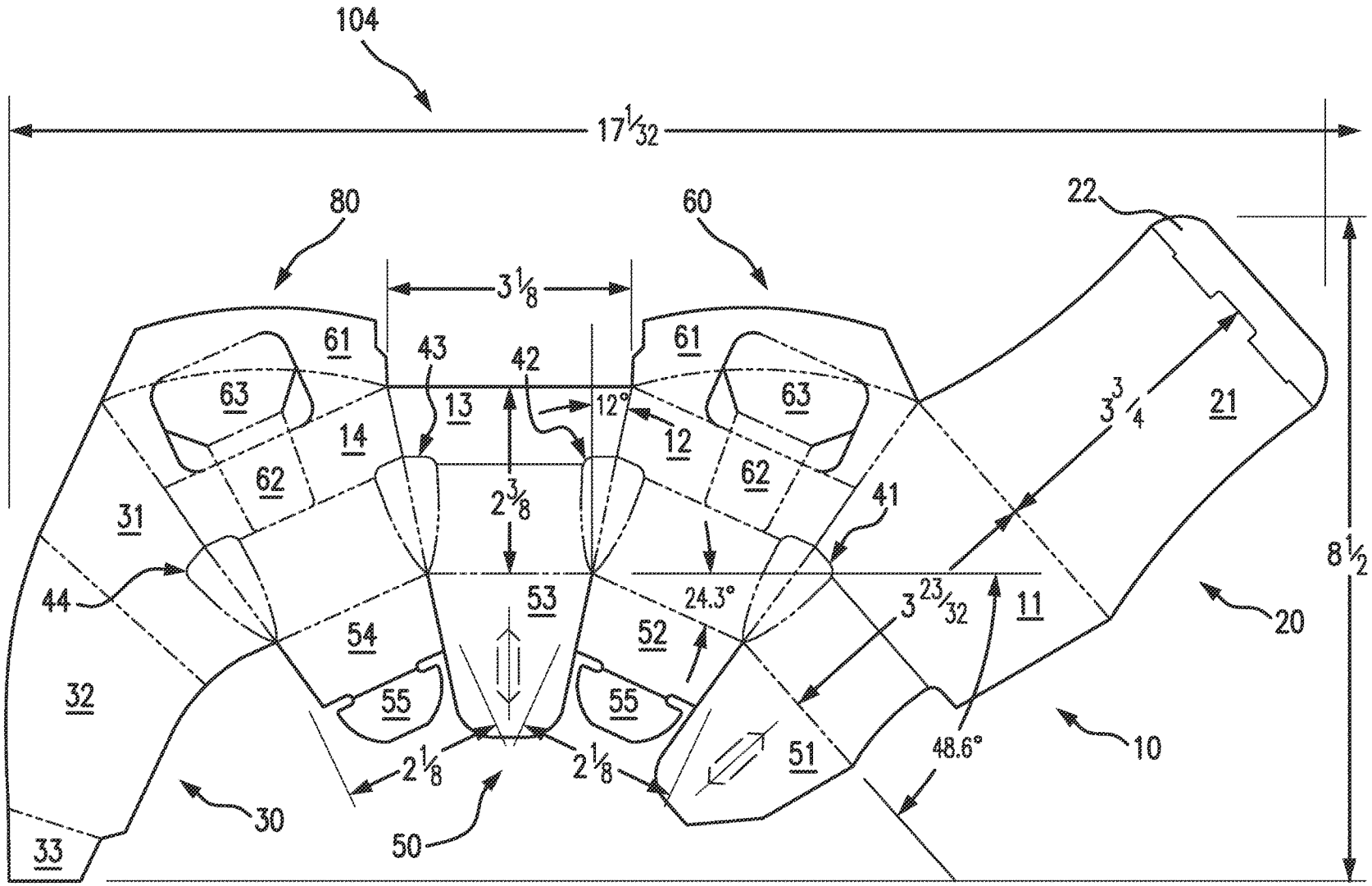
FIG. 6 is a plan view of another embodiment of a unitary blank for forming a food container in accordance with the disclosed subject matter.
Figure 7:
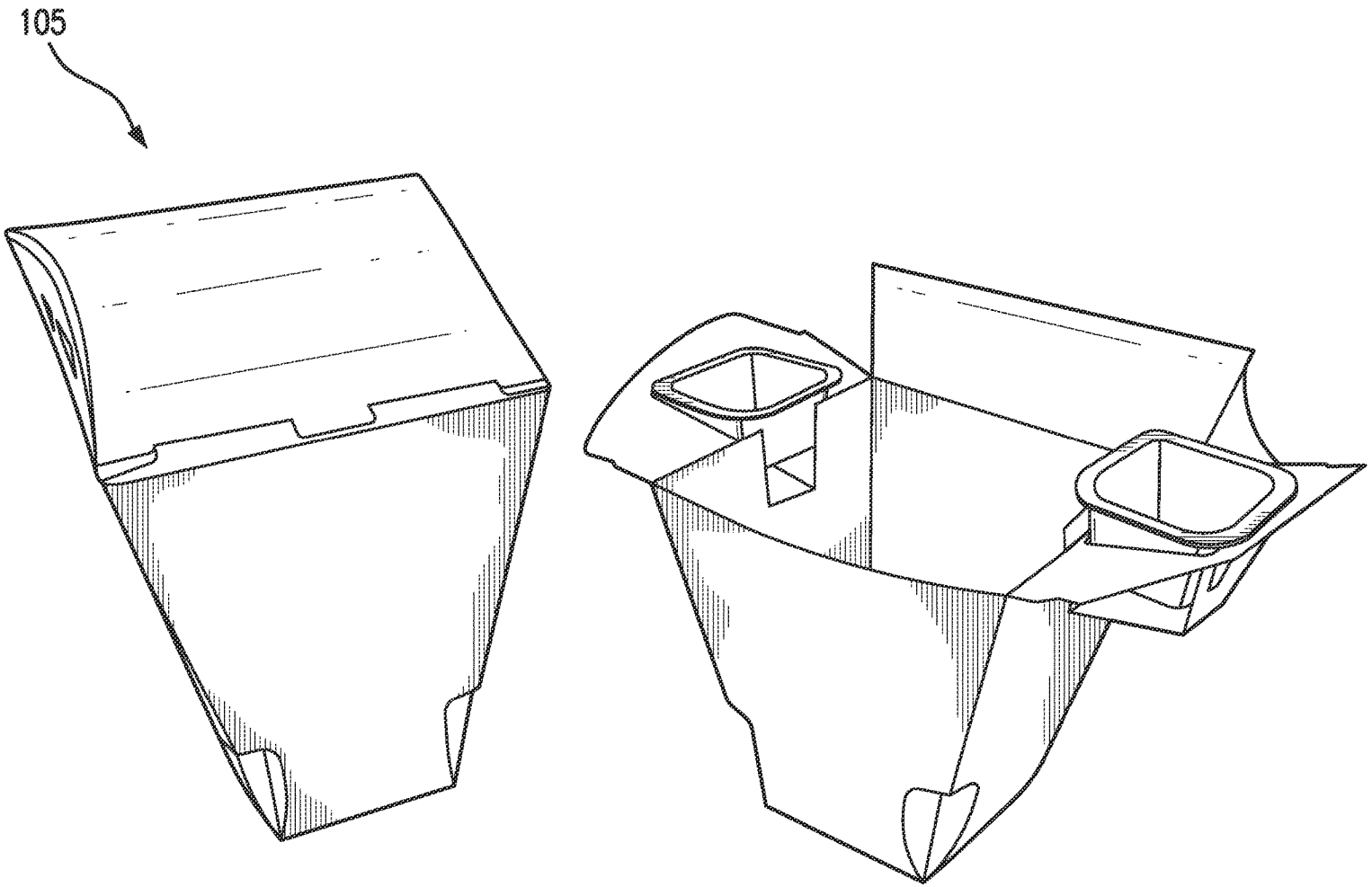
FIG. 7 is a perspective view of an exemplary embodiment of a container formed from the unitary blank of FIG. 8 in accordance with the disclosed subject matter.
Figure 8:
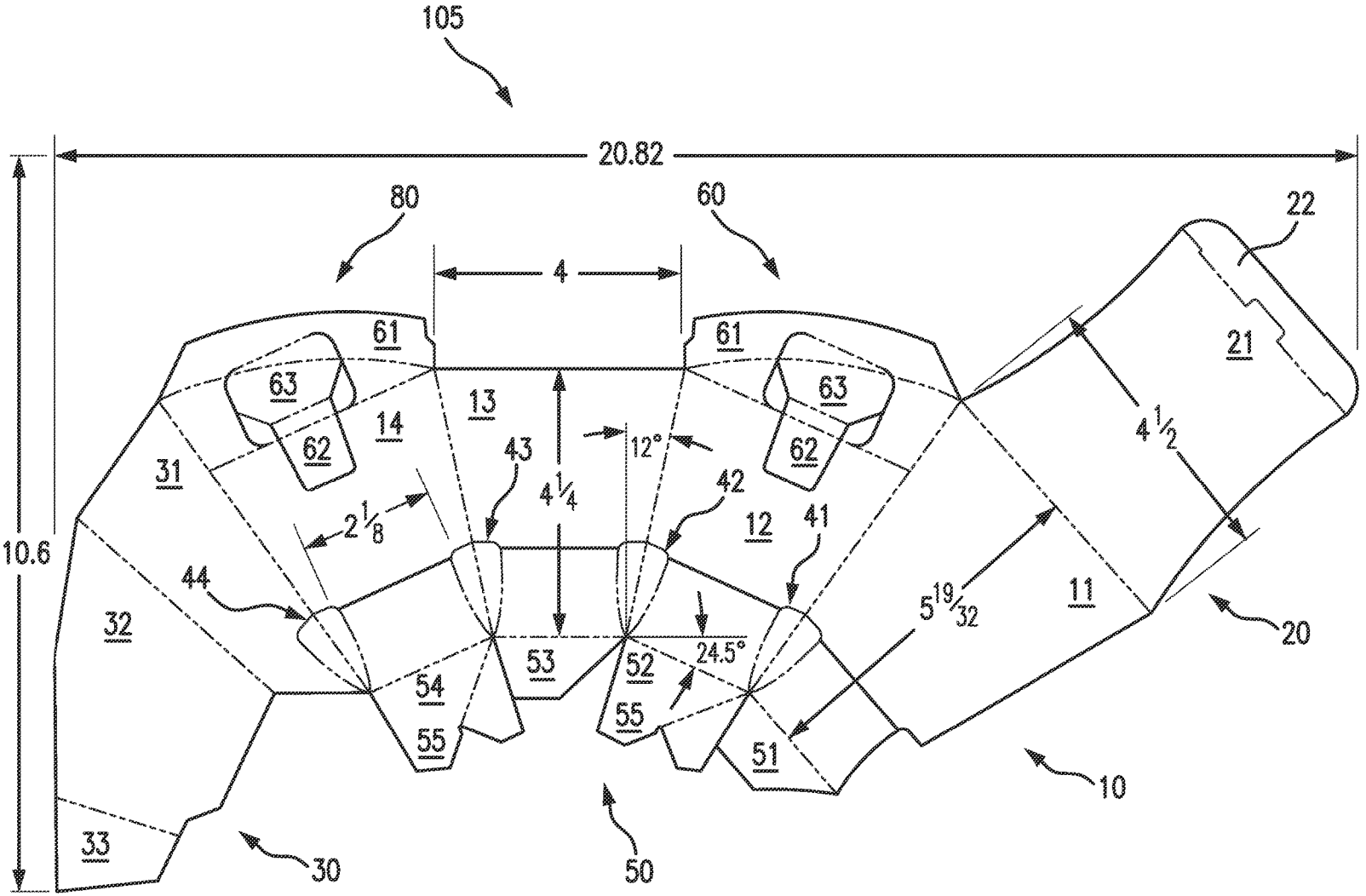
FIG. 8 is a plan view of another embodiment of a unitary blank for forming a food container in accordance with the disclosed subject matter.
Figure 9:
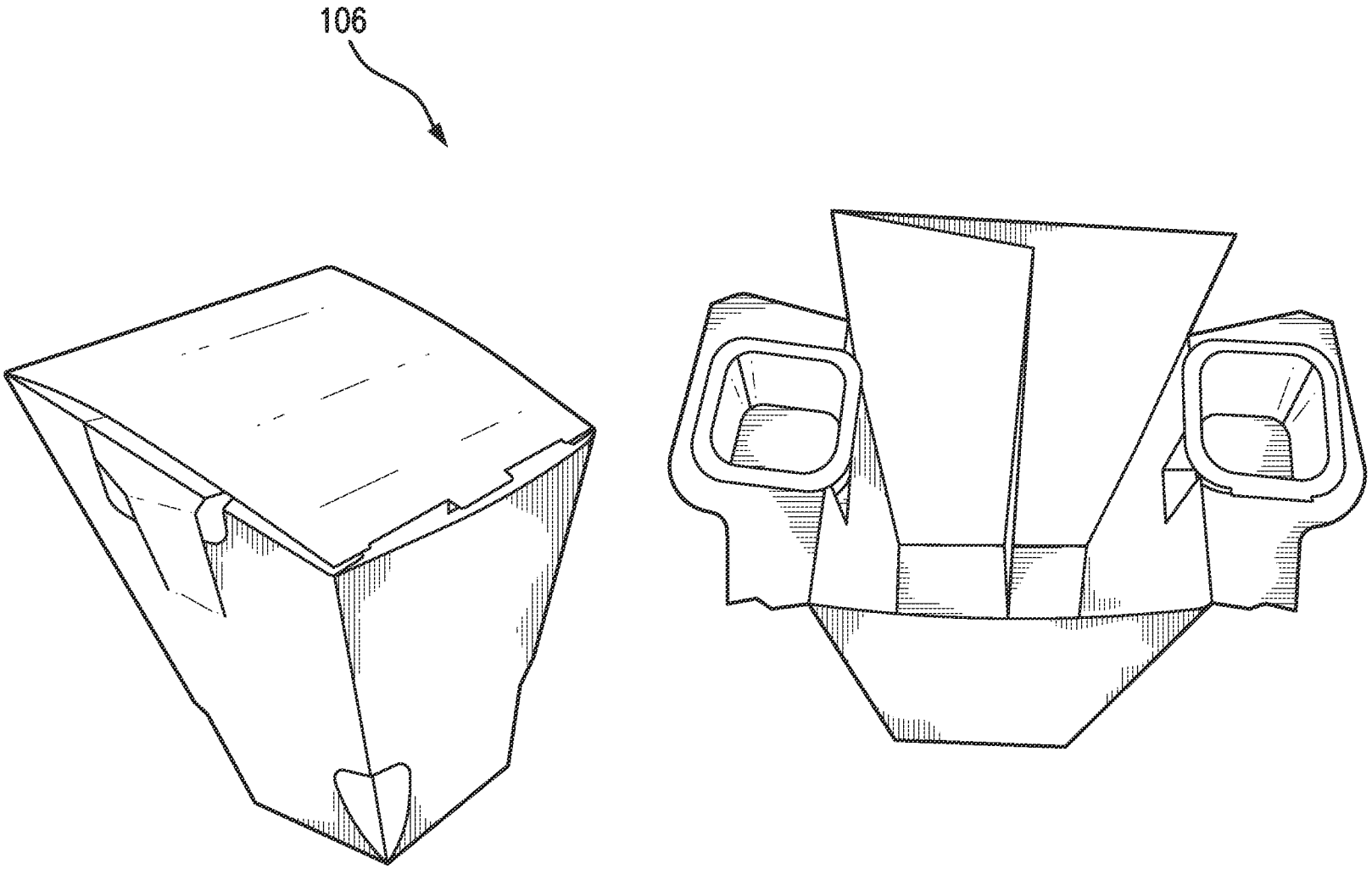
FIG. 9 is a perspective view of an exemplary embodiment of a container formed from the unitary blank of FIG. 10 in accordance with the disclosed subject matter.
Figure 10:
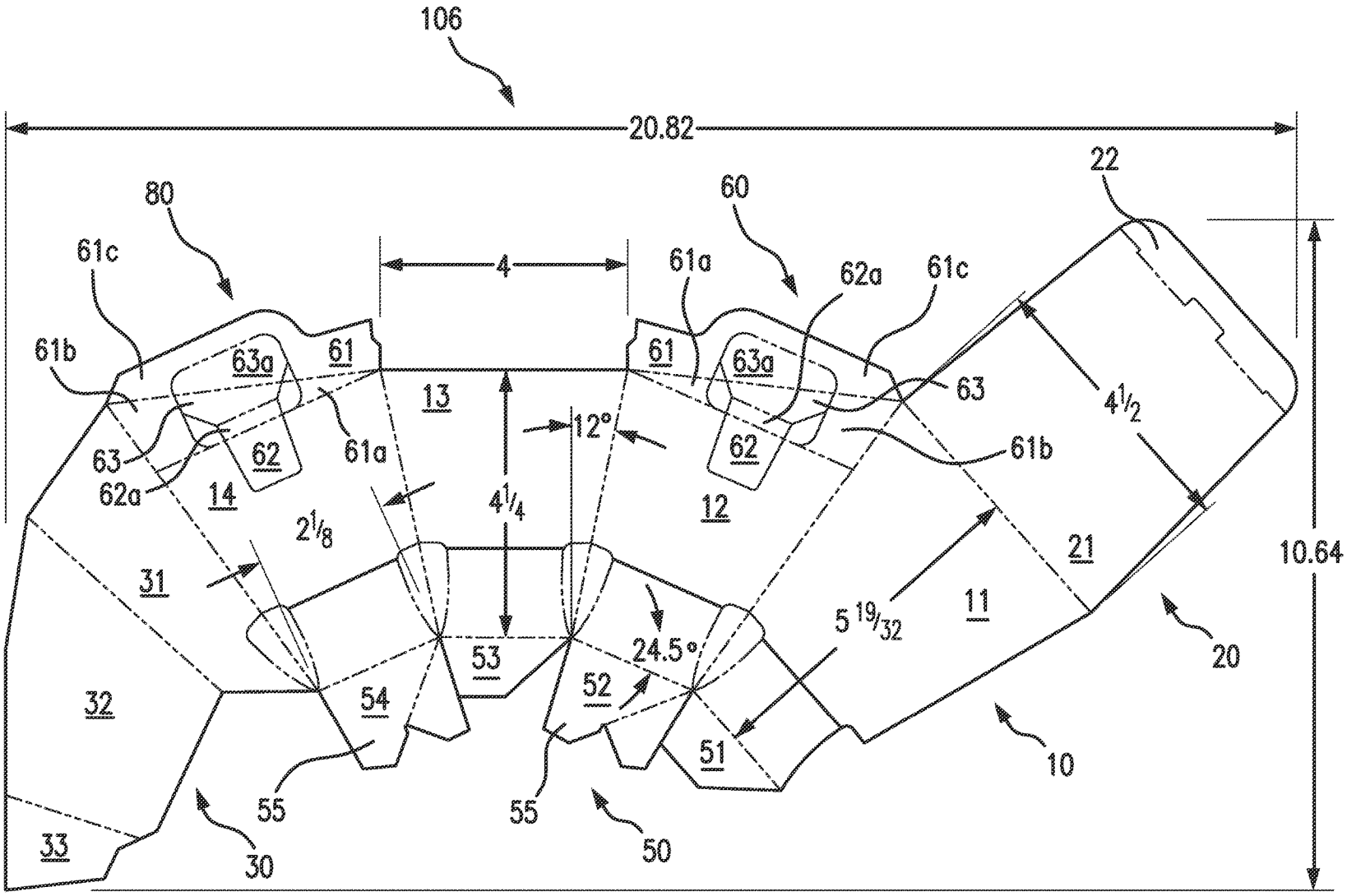
FIG. 10 is a plan view of another embodiment of a unitary blank for forming a food container in accordance with the disclosed subject matter.
Figure 11:
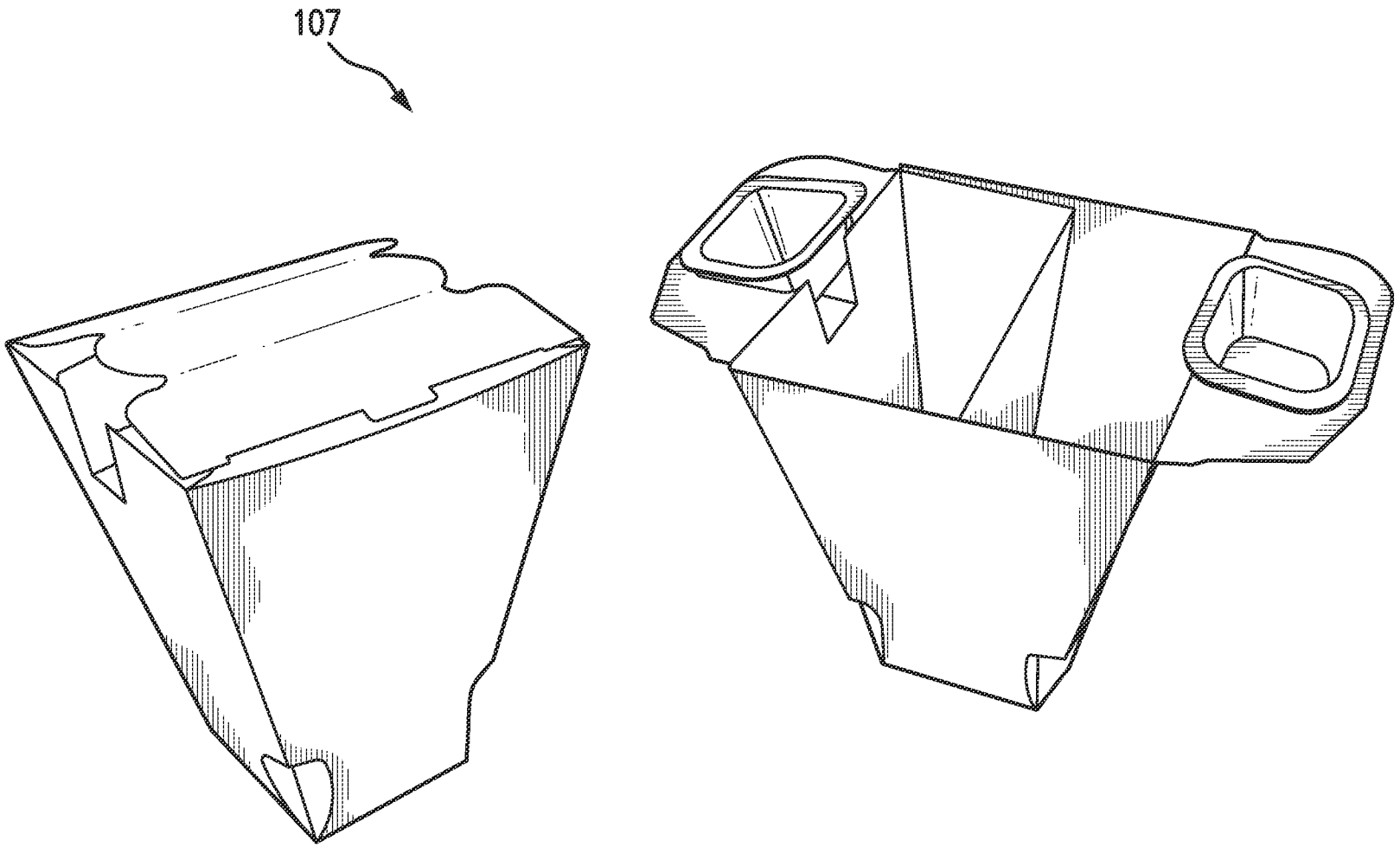
FIG. 11 is a perspective view of an exemplary embodiment of a container formed from the unitary blank of FIG. 12 in accordance with the disclosed subject matter.
Figure 12:
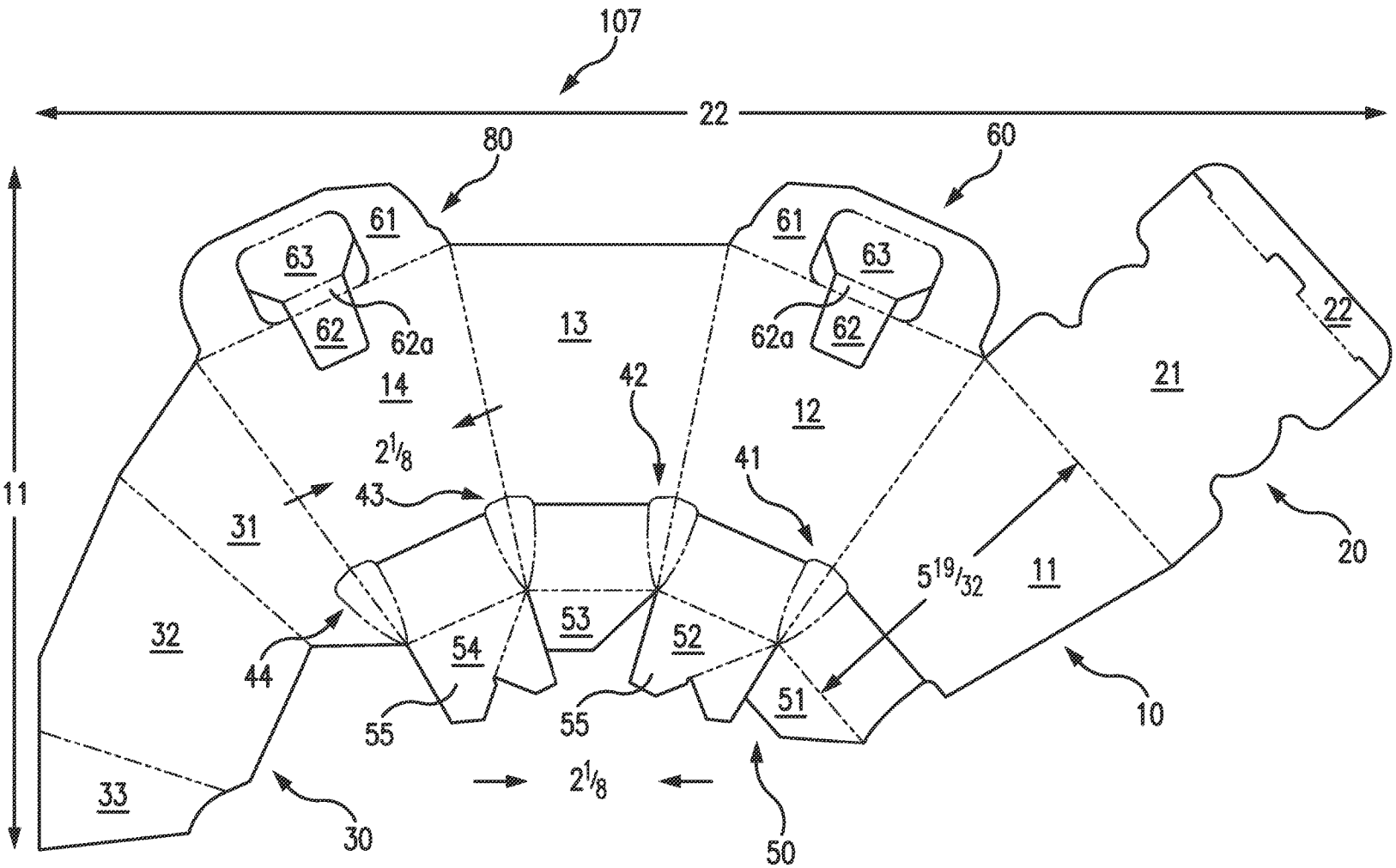
FIG. 12 is a plan view of an alternative embodiment of a unitary blank for forming a food container in accordance with the disclosed subject matter.
Figure 13:
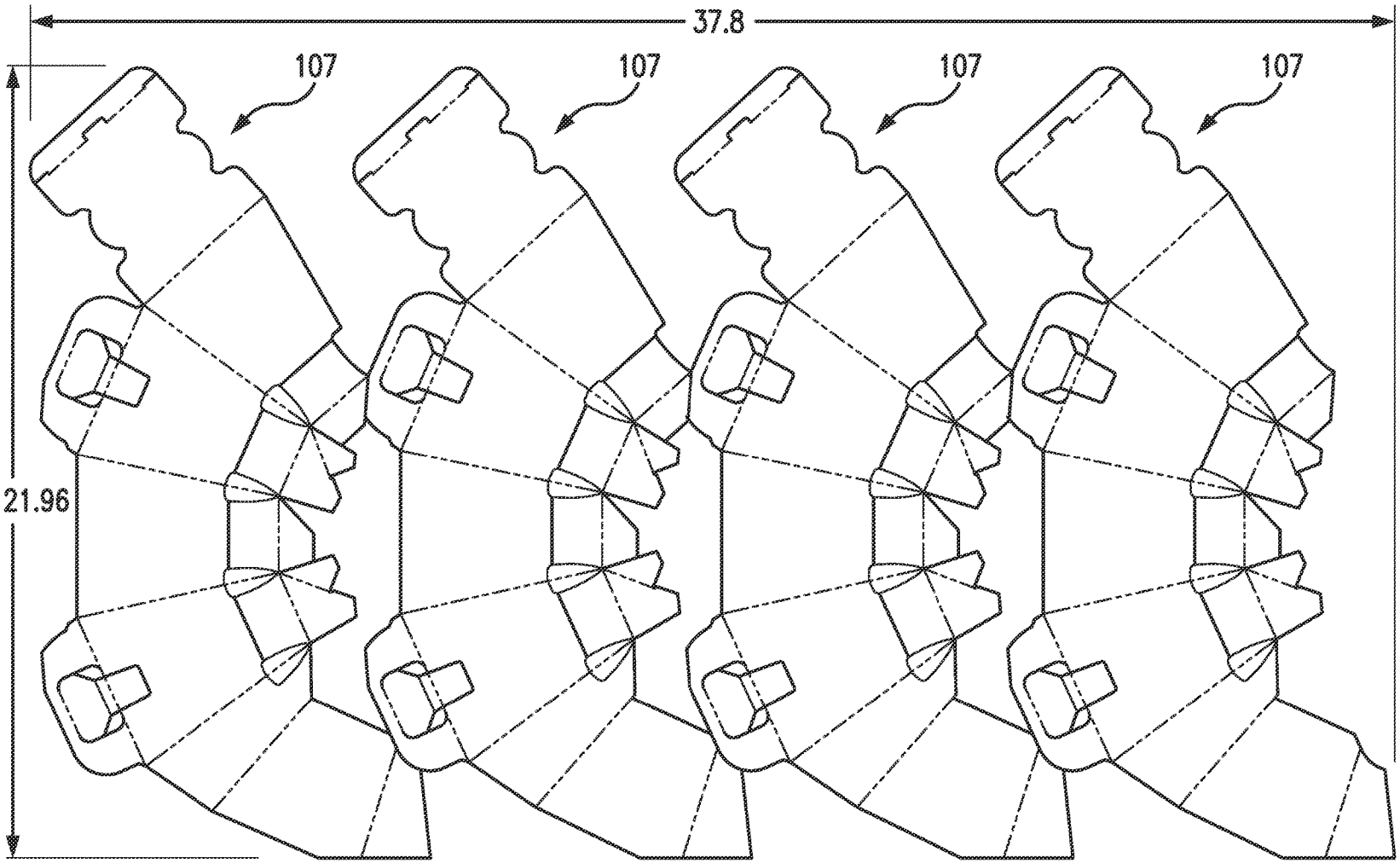
FIG. 13 is a plan view of a number of unitary blanks of FIG. 12 formed together on a sheet of material in accordance with the disclosed subject matter.
Figure 14:
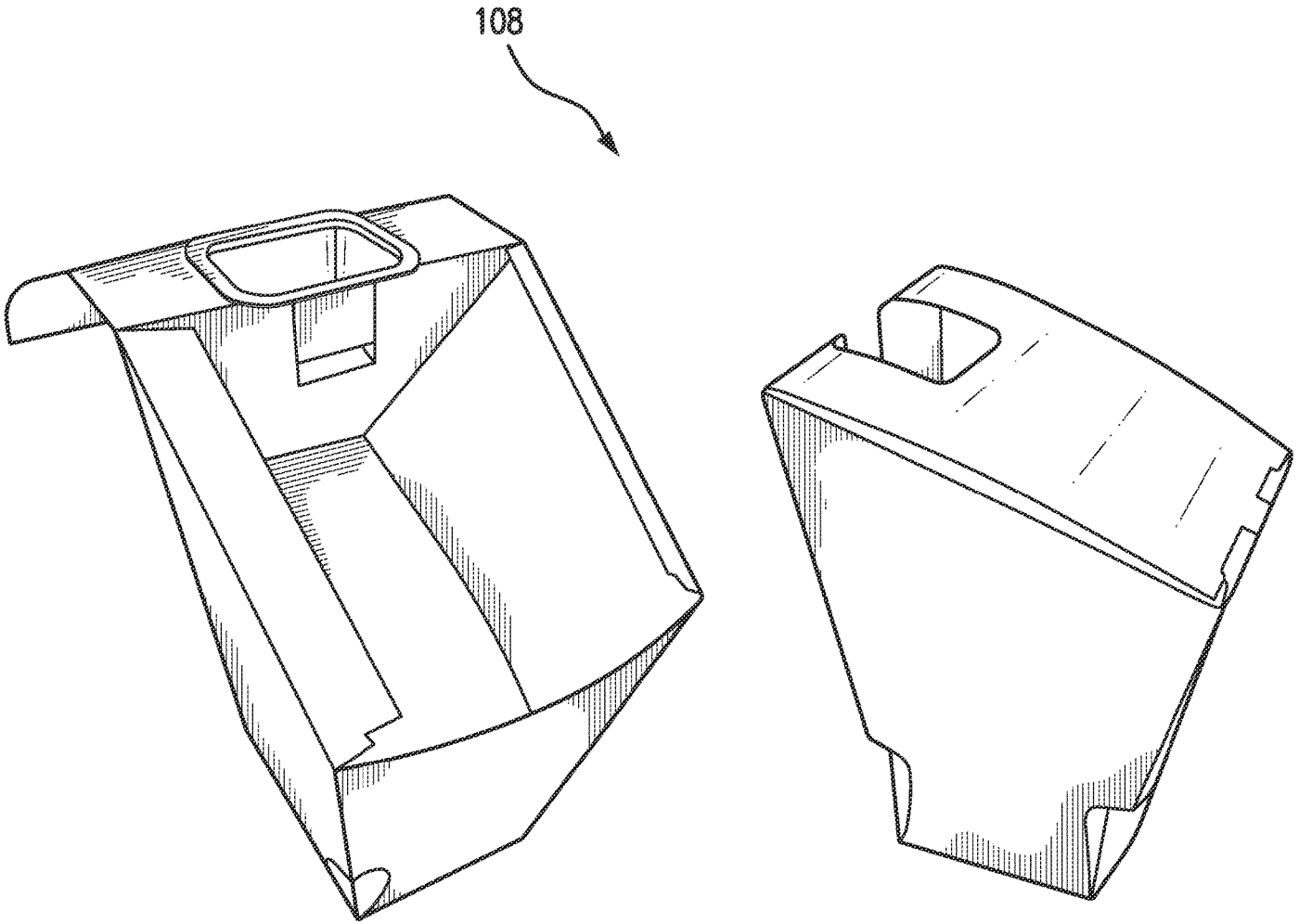
FIG. 14 is a perspective view of an exemplary embodiment of a container formed from the unitary blank of FIG. 15 in accordance with the disclosed subject matter.
Figure 15:
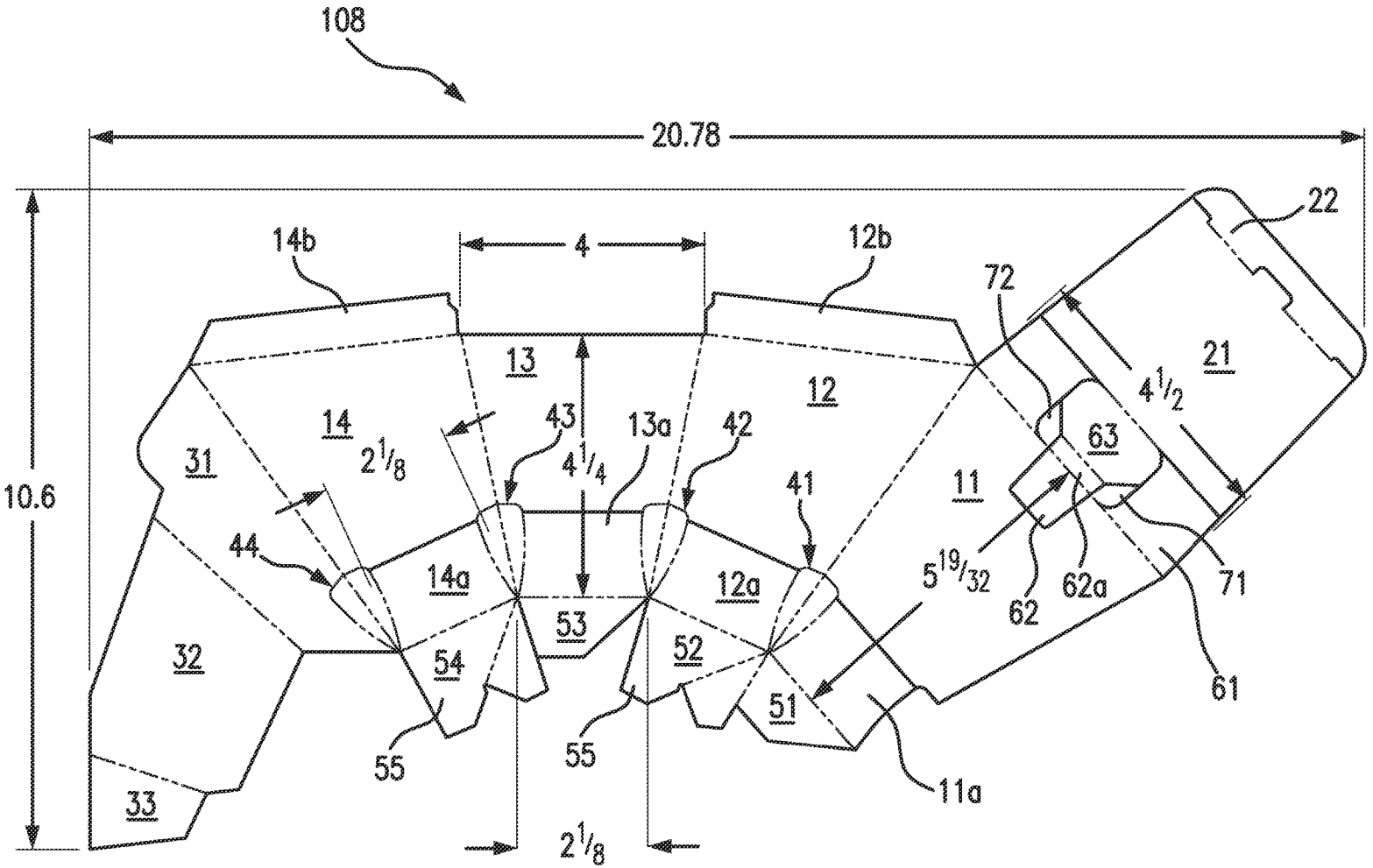
FIG. 15 is a plan view of another embodiment of a unitary blank for forming a food container in accordance with the disclosed subject matter.
Figure 16:
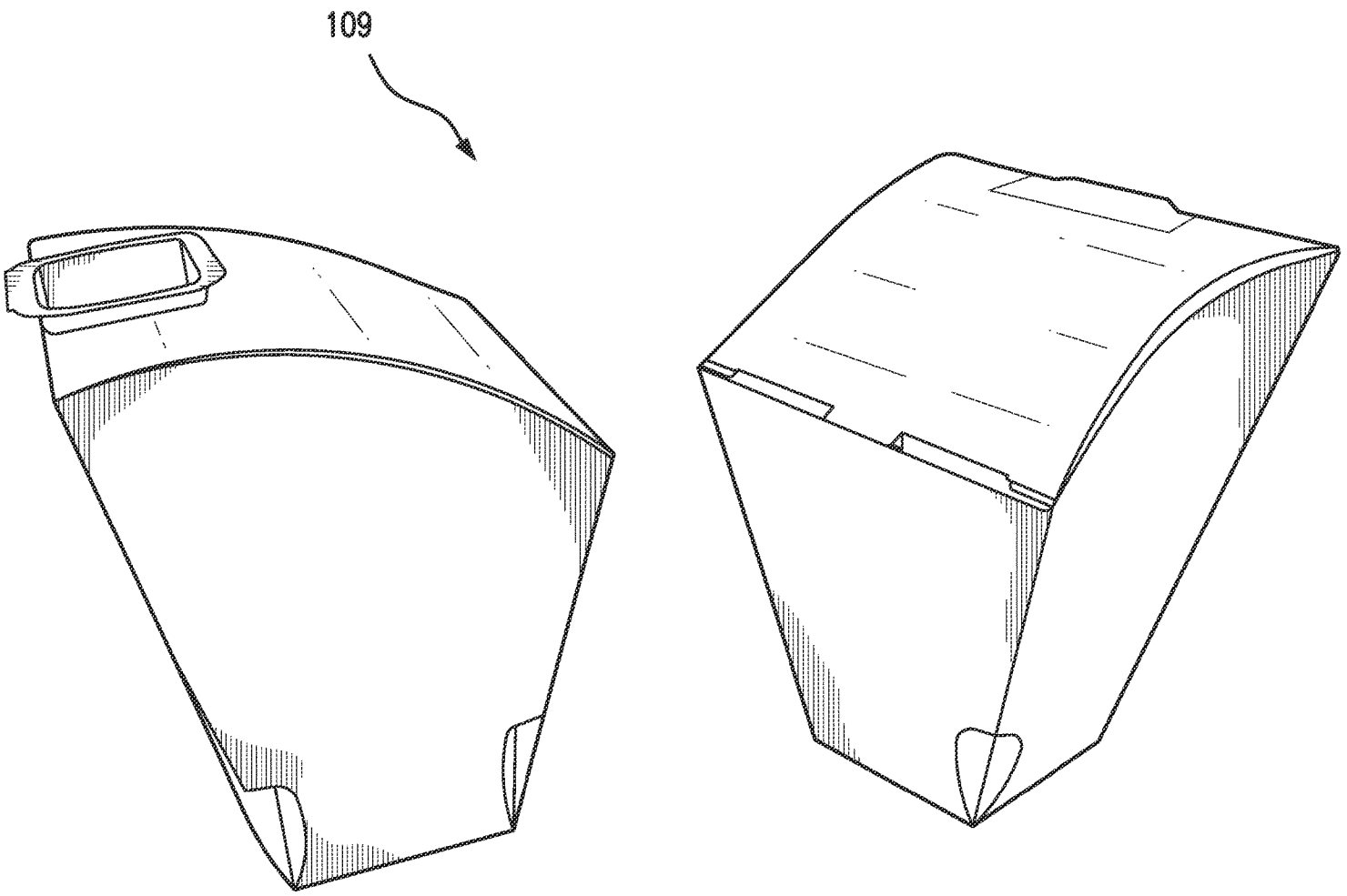
FIG. 16 is a perspective view of an exemplary embodiment of a container formed from the unitary blank of FIG. 17 in accordance with the disclosed subject matter.
Figure 17:
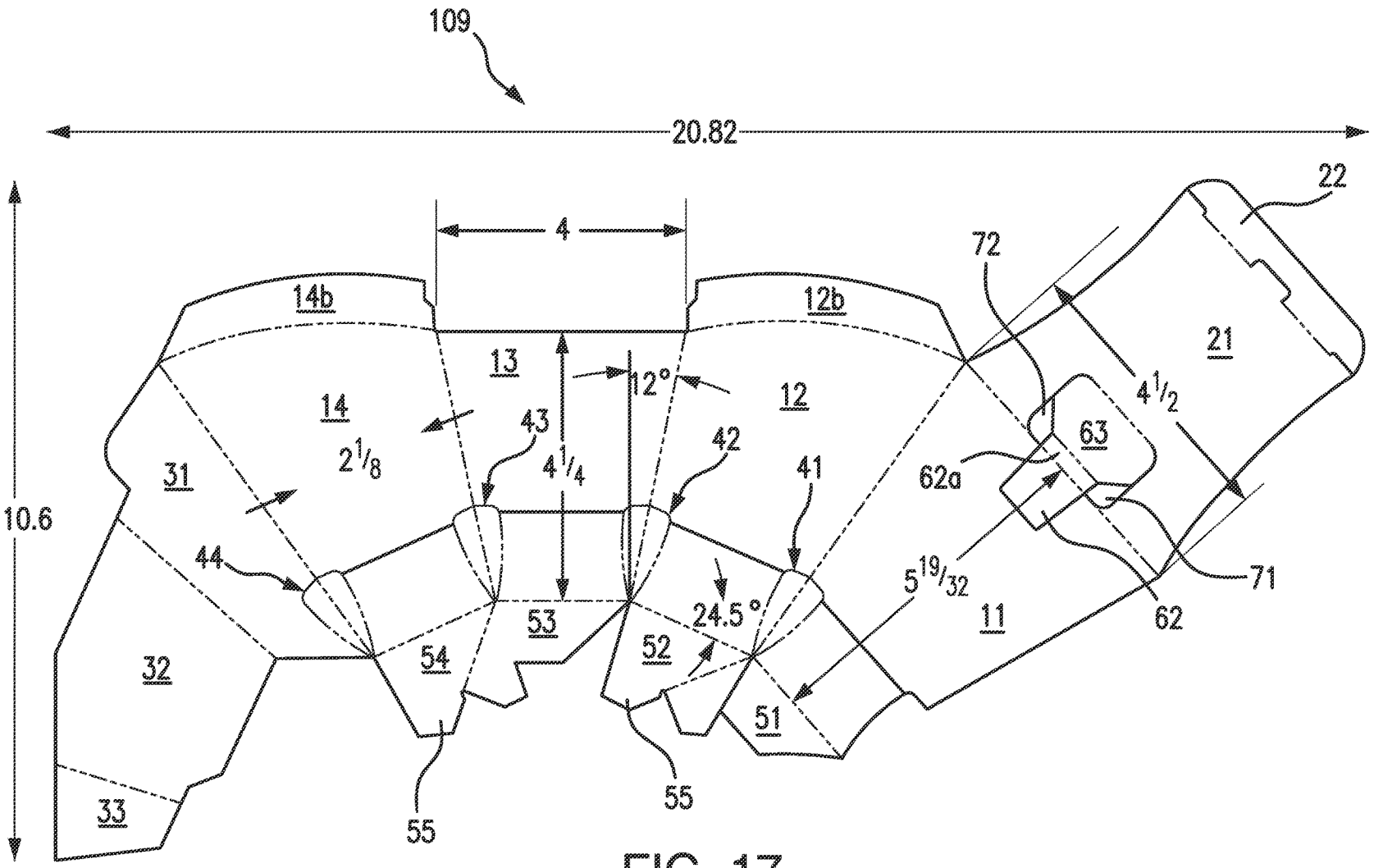
FIG. 17 is a plan view of another embodiment of a unitary blank for forming a food container in accordance with the disclosed subject matter.
Figure 18:
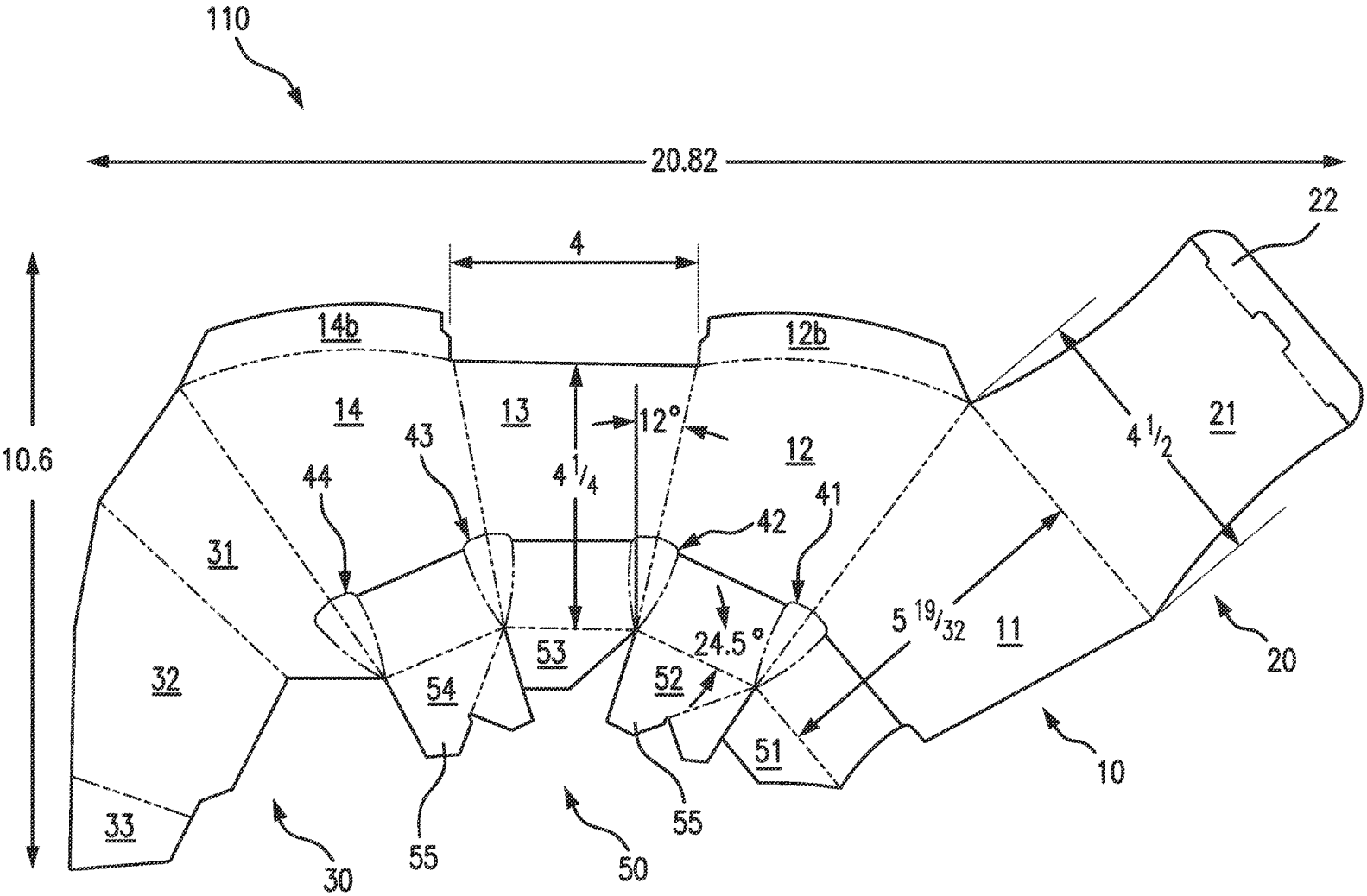
FIG. 18 is a plan view of another embodiment of a unitary blank for forming a food container in accordance with the disclosed subject matter.
Figure 19:
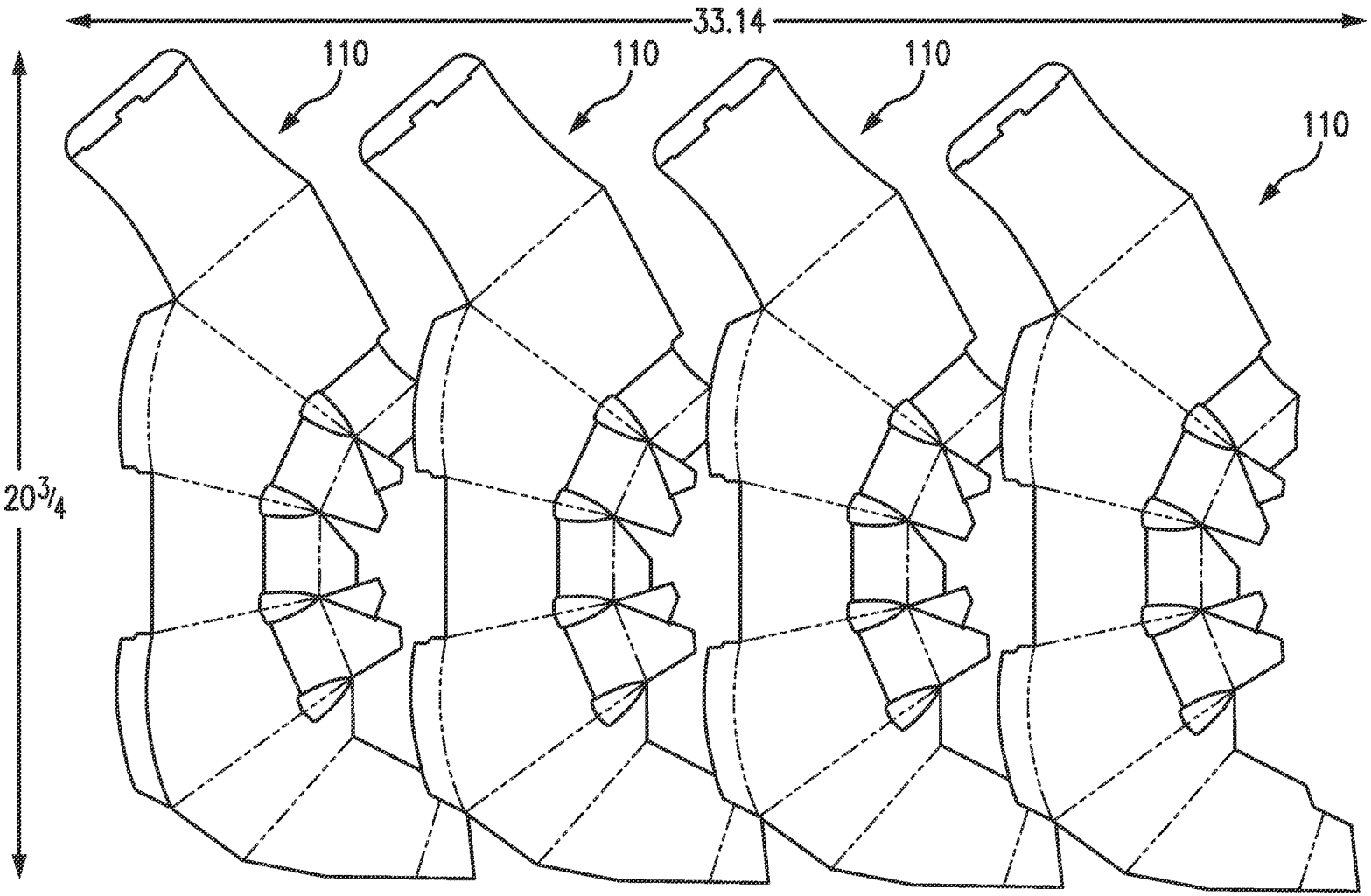
FIG. 19 is a plan view of a number of unitary blanks of FIG. 18 formed together on a sheet of material in accordance with the disclosed subject matter.
Figure 20:
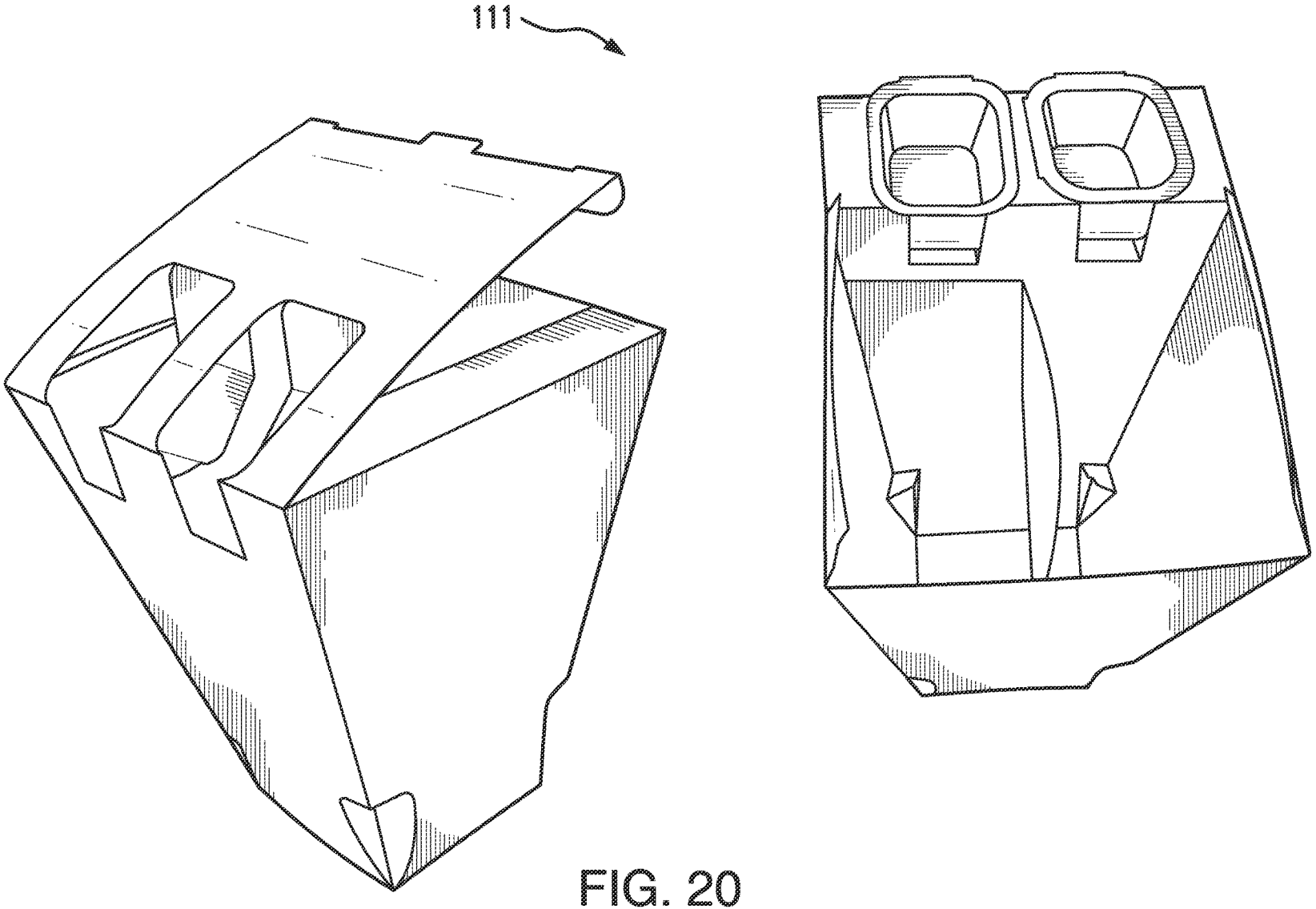
FIG. 20 is a perspective view of an exemplary embodiment of a container formed from the unitary blanks of FIG. 21 in accordance with the disclosed subject matter.
Figure 21:
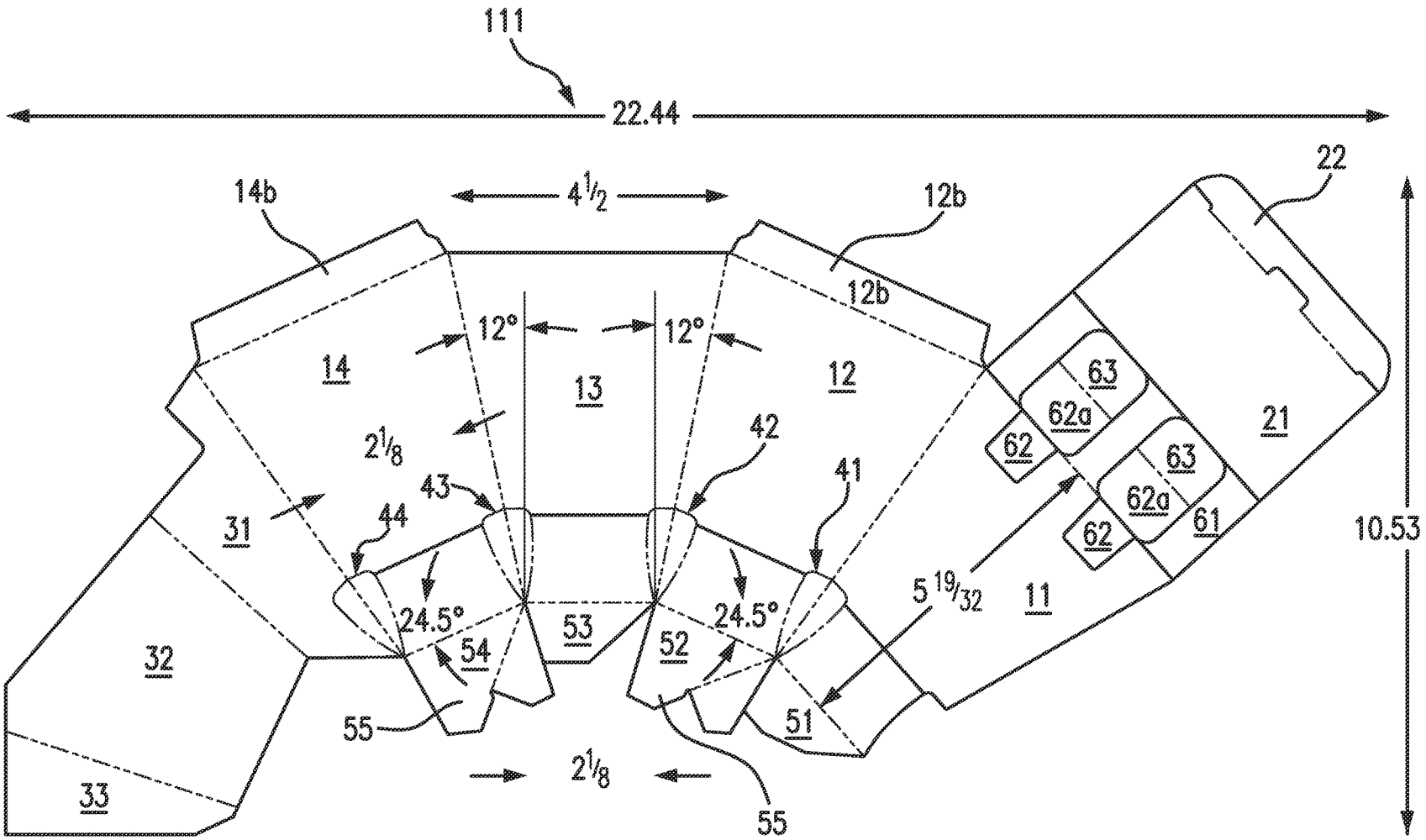
FIG. 21 is a plan view of another embodiment of a unitary blank for forming a food container in accordance with the disclosed subject matter.
Figure 22:
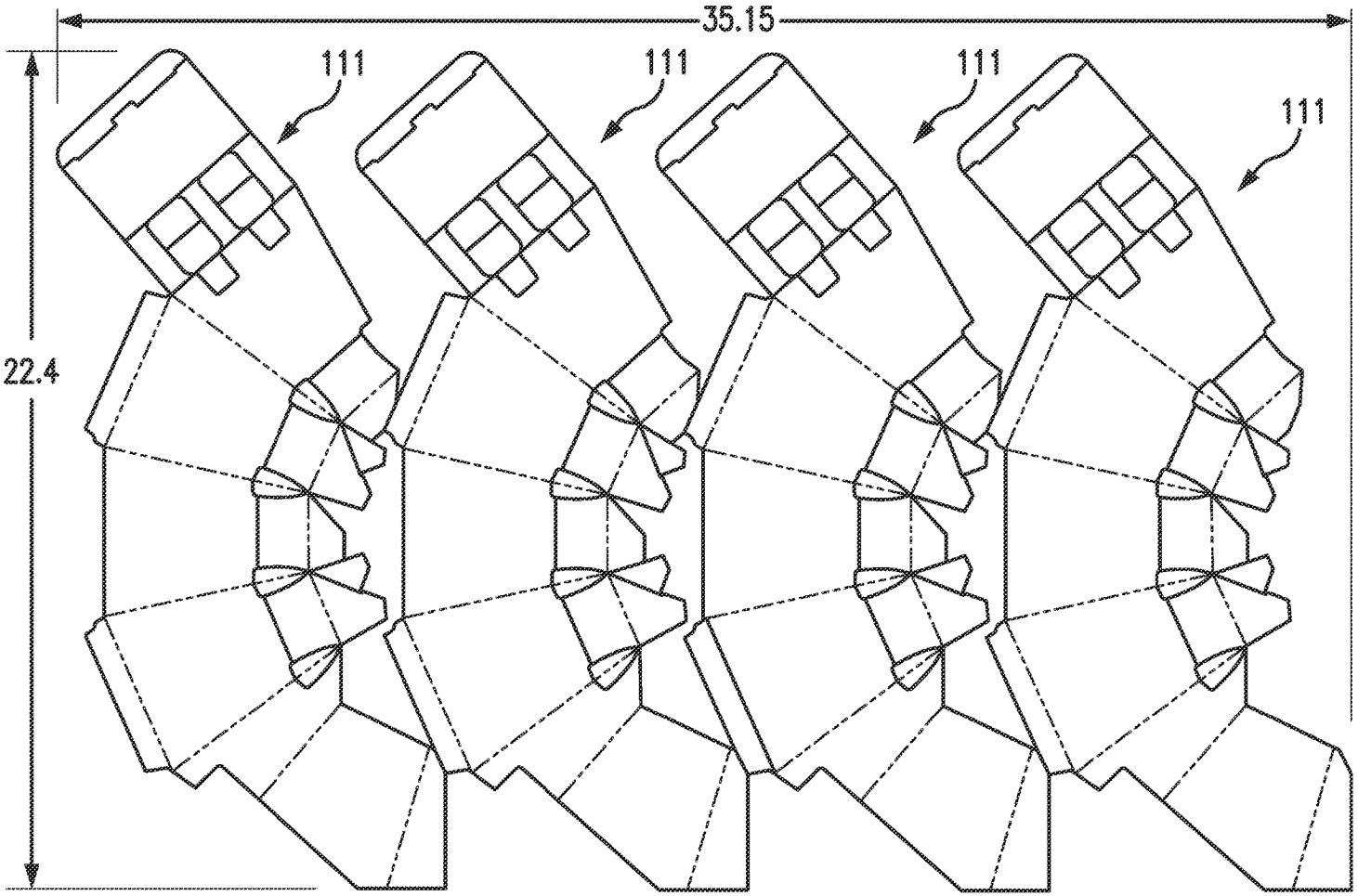
FIG. 22 is a plan view of a number of unitary blanks of FIG. 21 formed together on a sheet of material in accordance with the disclosed subject matter.
Figure 23:
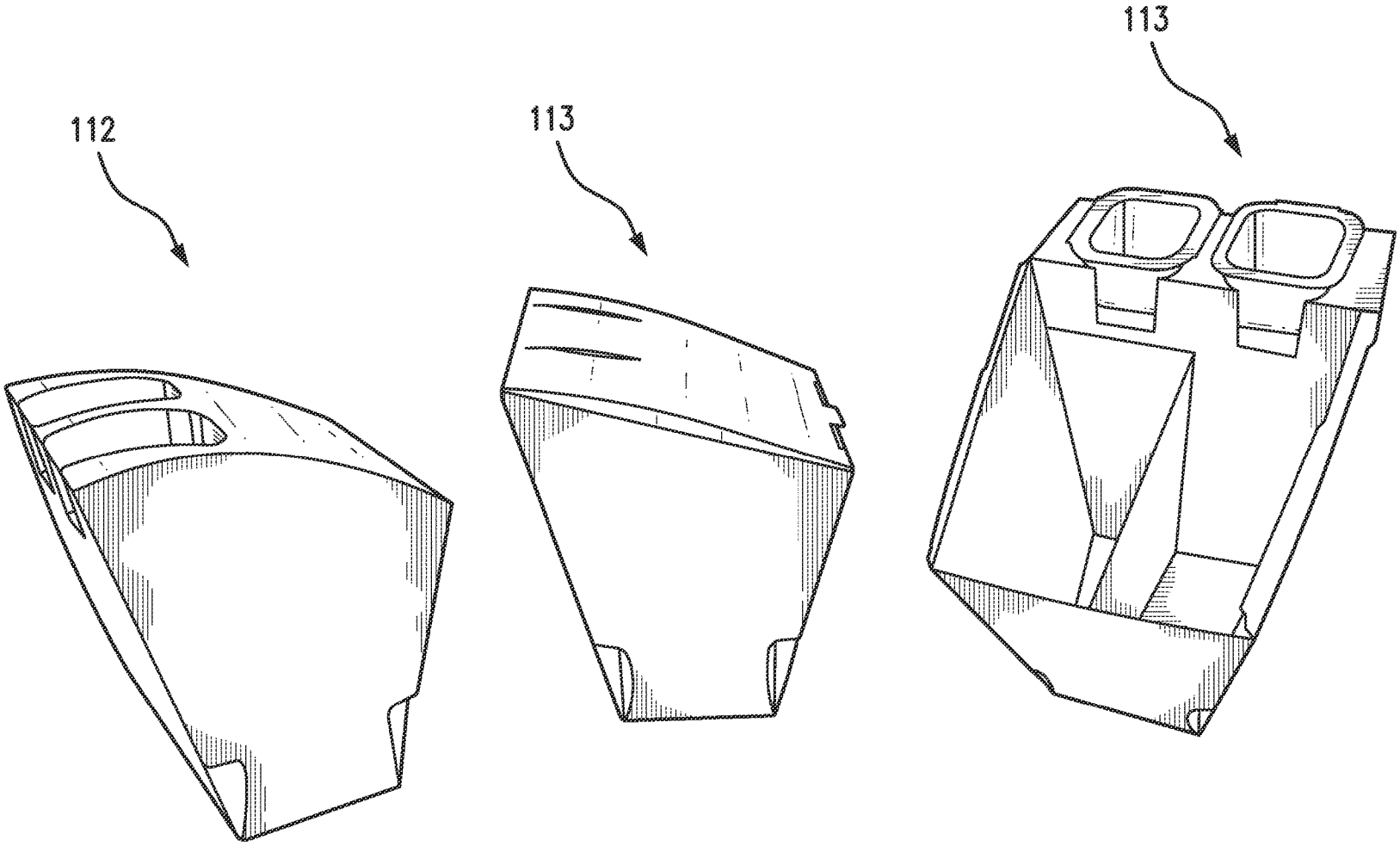
FIG. 23 is a perspective view of exemplary embodiments of containers formed from the unitary blanks of FIGS. 25 and 26 in accordance with the disclosed subject matter.
Figure 24:
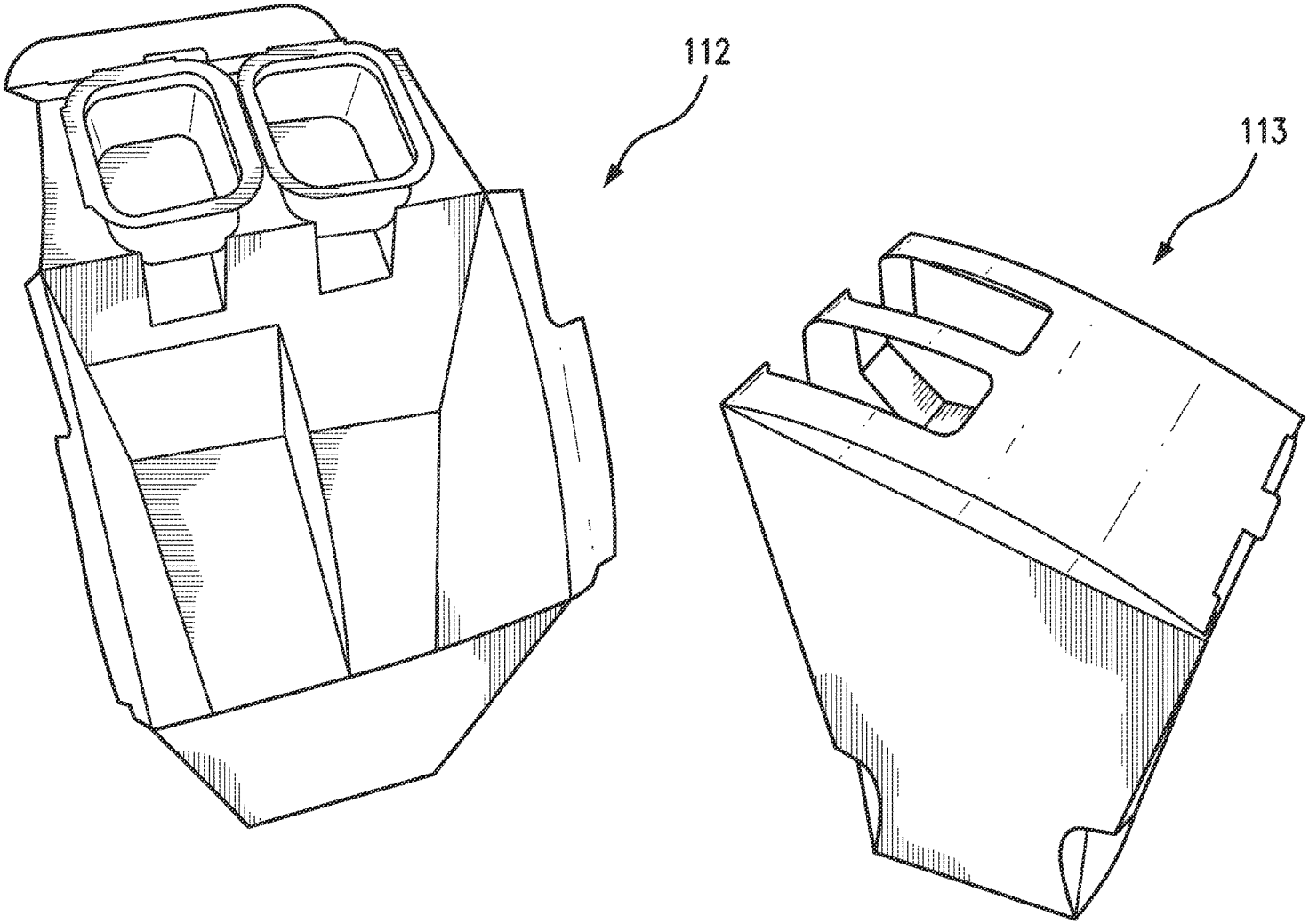
FIG. 24 is a perspective view of exemplary embodiments of containers formed from the unitary blanks of FIGS. 25 and 26 in accordance with the disclosed subject matter.
Figure 25:
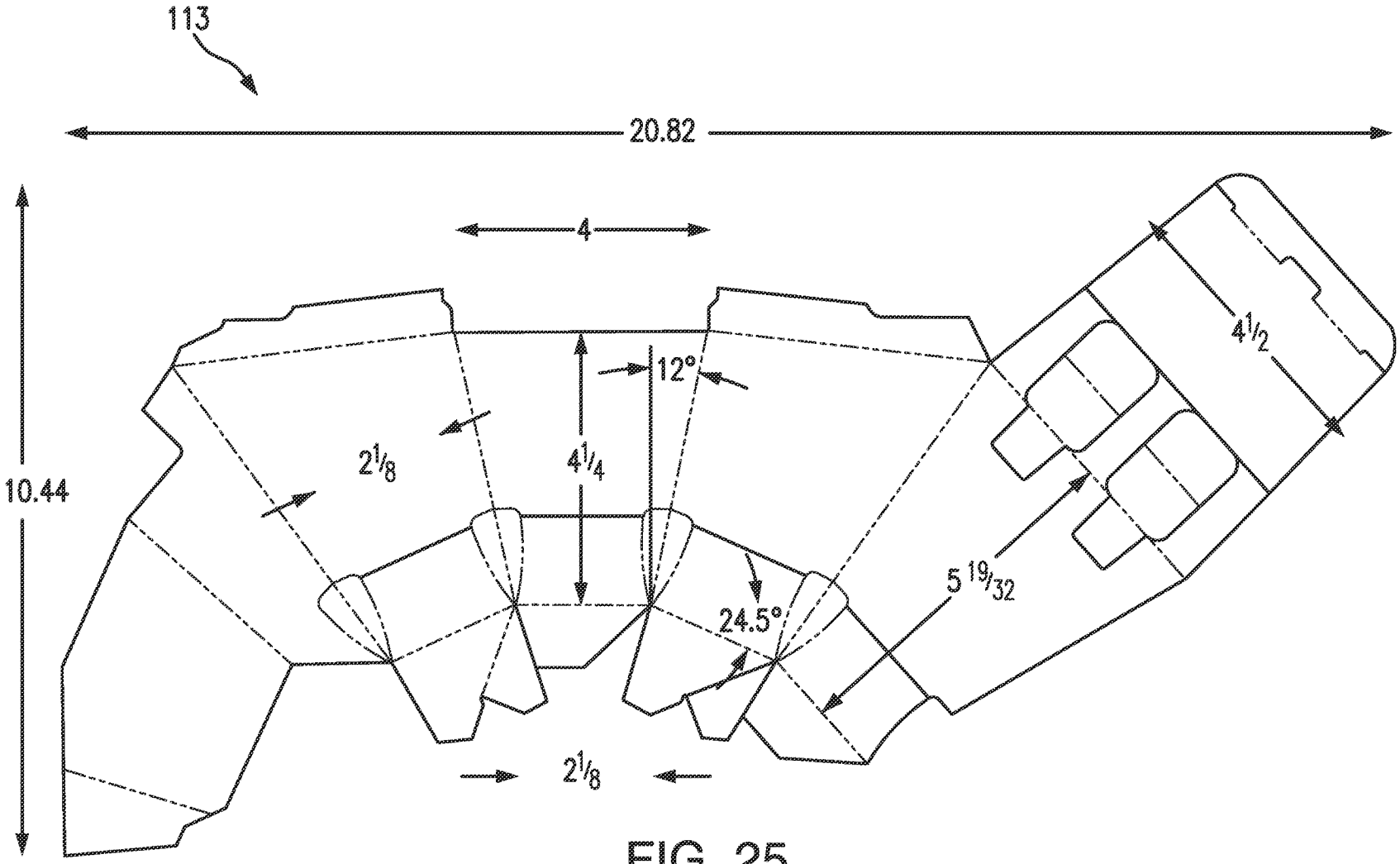
FIG. 25 is a plan view of another embodiment of a unitary blank for forming a food container in accordance with the disclosed subject matter.
Figure 26:
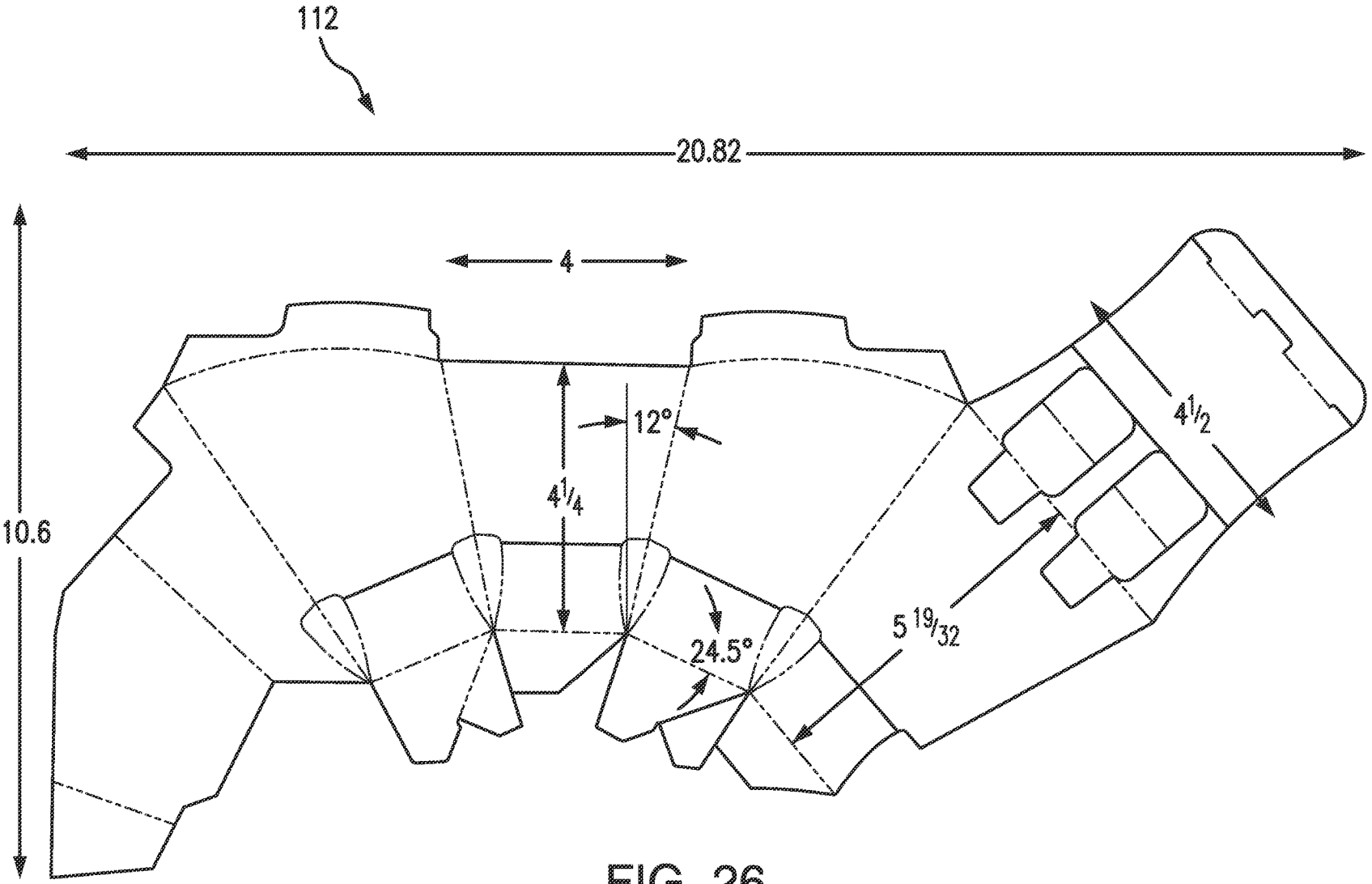
FIG. 26 is a plan view of another embodiment of a unitary blank for forming a food container in accordance with the disclosed subject matter.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of unitary blanks and containers formed from the unitary blanks in accordance with the disclosed subject matter are shown in FIGS. 1-26. The container is suitable for use with a wide variety of hot and cold food items, such as fruit slices, chips, bread sticks, candies, and other suitable bite-size food items, particularly if typically consumed with a dipping sauce or the like. However, the container disclosed herein is particularly suitable and beneficial for use with hot, prepared food items, such as chicken nuggets, french fries, onion rings, and popcorn shrimp, that are typically served with a condiment for dipping, such as ketchup, mustard, mayonnaise, or vinegar, wherein the container can be used for storing, transporting, and/or re-using such food items as well as serving the food items and allowing for dipping of the food items into the condiment. Further, the container desirably can have insulating properties to assist in maintaining the temperature of food contained therein as well as venting properties to allow for removal of excess moisture. For purpose of illustration, and not limitation, reference will made herein to a container intended to contain food items and hold a receptacle for a condiment. Additionally, as used herein, the terms "front," "rear," "side," "top," and "bottom" are used for the purpose of illustration only, and not limitation. That is, it is recognized that the terms "front," "rear," "side," "top," and "bottom" are interchangeable and are merely used herein as a point of reference.

For purpose of illustration, and not limitation, reference is made to the exemplary embodiment of a containers and corresponding blanks 101-113 shown in FIGS. 1-26. As shown in FIGS. 1-26, the containers and corresponding blanks 101-113 generally include first, second, third, and fourth body portions. A first body portion 11 can have a first base edge at least partially defined by a first body portion base fold line. A second body portion 12 can be joined to the first body portion 11 by a first body fold line and can have a second base edge at least partially defined by a second body portion base fold line. A third body portion 13 can be joined to the second body portion 12 by a second body fold line and can have a third base edge at least partially defined by a third body portion base fold line. A fourth body portion 14 can be joined to the third body portion 13 by a third body fold line and can have a fourth base edge at least partially defined by a fourth body portion base fold line.

As embodied herein, A first flap 30 can extend from the fourth body portion 14 opposite the third body fold line and can be defined by a first flap fold line. The first flap 30 can have a first engagement portion 31 adjacent to the fourth body portion 14, which can be defined by a first flap engagement fold line. A second engagement portion 33 of the first flap 30 can be opposite the fourth body portion 14 and can be defined by a second flap engagement fold line. A central portion 32 can be defined between the first flap engagement fold line and the second flap engagement fold line. The first engagement portion 31 can be disposed to engage the first body portion 11 when the first flap 30 is folded along the first flap line. The central portion 32 can be disposed to form an interior dividing wall when the central portion 32 is folded along the first flap engagement line. The second engagement portion 33 can be disposed to engage the third body portion 13 when the second engagement portion 33 is folded along the second flap engagement fold line.

For purpose of illustration and not limitation, a first inwardly folding panel 41 can be disposed between the first body portion 11 and the second body portion 12 along the first body fold line. A second inwardly folding panel 42 can be disposed between the second body portion 12 and the third body portion 13 along the second body fold line. A third inwardly folding panel 43 can be disposed between the third body portion 13 and the fourth body portion 14 along the third body fold line. A fourth inwardly folding panel 44 can be disposed between the fourth body portion 14 and the first flap 30 along the first flap fold line.

For example and not limitation, a first base portion 51 can extend from the first body portion 11 base edge. A second base portion 52 can extend from the second body portion 12 base edge. A third base portion 53 can extend from the third body portion 13 base edge. A fourth base portion 54 can extend from the fourth body portion 14 base edge. The second base portion 52 and the fourth base portion 54 each can have an engagement feature 55 disposed thereon. The base portions 51, 52, 53, 54 can form a base 50 when joined together.

As embodied herein and shown in FIGS. 1-13, a second flap 60 can extend from the second body portion 12 opposite the second body portion 12 base edge and can be defined by a second flap fold line. The second flap 60 can have a first foldable support formed therein. The first foldable support can be joined to the second flap 60 by a first foldable support flap fold line. Additionally, the first foldable support can be joined to the second body portion 12 by a first foldable support body fold line.

Additionally or alternatively, a third flap 80 can extend from the fourth body portion 14 opposite the fourth body portion base edge and can be defined by a third flap fold line. The third flap 80 can have a second foldable support formed therein. The second foldable support can be joined to the third flap 80 by a second foldable support flap fold line. Additionally, the second foldable support can be joined to the fourth body portion 14 by a second foldable support body fold line.

Each foldable support (e.g. of the second flap 60 and/or the third flap 80) generally can be divided into three sections. A substantially trapezoidal first support portion 63 can be joined to the rim 61 at a foldable support flap fold line. A rectangular second support portion 62 can be joined to the respective body portion (e.g. second body portion 12 or fourth body portion 14) at a foldable support body fold line. A third support portion 62*a* can be joined to the first support portion 63 at a third support portion first fold line and the second support portion 62 at a third support portion second fold line. The second support portion 62 can be further joined to the respective body portion (e.g. second body portion 12 or fourth body portion 14) by parallel second support portion perforated lines, which can extend perpendicular to and between the foldable support body fold line and the third support portion second fold line. Additionally, a fourth support portion 63*a* can be joined to the second support portion 62*a* and can be defined by a fourth support portion first fold line.

As embodied herein and shown in FIGS. 1-26, a fourth flap 20 can extend from the first body portion 11 opposite the first body portion 11 base edge and can be defined by a fourth flap fold line. The fourth flap 20 can be moveable between an open position and a closed position. The fourth flap 20 can include a main portion 21 and a tab 22 to engage the third body portion 13 when in the closed position.

As embodied herein and shown in FIGS. 14-26, the fourth flap 20 can have a foldable support formed therein. The foldable support can be joined to the fourth flap by a foldable support flap fold line. Additionally, the foldable support can be joined to the first body portion by a foldable support body fold line.

Exemplary embodiments of the disclosed subject matter can include a container or a blank for forming a container having a divider to divide the containers into one or more compartments (for purpose of illustration and not limitation, see containers and corresponding blanks 101-113). Exemplary containers having dividers can also be found in U.S. Provisional Patent Application No. 62/000,704, filed May 20, 2014, which is incorporated by reference herein in its entirety. For purpose of illustration and not limitation, containers 101-113 can be sized to fit into a standard car cup holder. As embodied herein, the containers can include divided, open top, scoop designs (for example and as embodied herein with a flap 30 disposed to form an integral sliding divider).

For purpose of illustration and not limitation, the body portions of the container (e.g. body portions 11, 12, 13, and 14) can have a tapered sidewall, which can increase product holding capacity. For purpose of illustration and not limitation, as embodied herein, the sidewalls can taper at an angle of 12 degrees. However, any suitable degree of taper can be used depending on the desired application, capacity and/or base profile. Additionally, the blanks 101-113 can be adapted to form folding carton containers 101-113, which can include an auto-bottom style glued base 50 (see e.g., FIGS. 7-26) or a double center locking bottom tuck arrangement (see e.g., FIG. 3, see also FIGS. 1-2, 4-6) that can secure the bottom panels (51, 52, 53, 54) together and can provide mounting portions (e.g. when tabs 55 are inserted into perforation 56 proximate to perforations 57 and 58) which can secure the compartment divider panel (e.g. center portion 32 of flap 30) in a desired position. The latter configuration, for example, can be formed without adhering the divider panel (e.g. flap 30) to the carton front body panel (e.g. body portion 13) by means of a glued flap (e.g. engagement portion 33).

For example and not limitation, the tuck flap base closure arrangement can provide improved product compartmental division. As embodied herein, the divider panel (e.g. central portion 32 of flap 30) and the double bottom tuck mounting portions can prevent or inhibit food from travelling from one compartment side to the other. Alternatively, for example and not limitation, the auto-bottom flap base closure arrangement can include inner carton clearance for the initially inwardly-folded auto-bottom flaps. As such, the product divider panel can, for example, be configured to not extend down into the base 50 of the container. For example and not limitation, the divider panel can remain raised by approximately 1 and ⅛ inches, which can allow some smaller products to migrate from one side of the divided carton to the opposite side.

For purpose of illustration and not limitation, the tapered container can include inwardly folding panels 41, 42, 43, 44, embodied herein proximate the corners of the body 10 of the container proximate to the base 50, to allow the container to securely fit into a standard car cup holder. For example and not limitation, as embodied herein, each inwardly folding panel (e.g. inwardly folding panel 41) can be triangular, and can have a first side (e.g. 41*a*) and a second side (e.g. 41*b*) separated by a fold line. For purpose of illustration and not limitation, the fold line of each inwardly folding panel 41, 42, 43, 44 can be substantially parallel to and/or coincident with the fold lines between the respective body panels 11, 12, 13, 14 and flap 30. The inwardly folding panels 41, 42, 43, 44 can be activated by seating the container on top of a cavity (for example and without limitation, a standard cup holder cavity in a car) and urging the container downward into the cavity. The inwardly folding panels 41, 42, 43, 44 can fold or deflect inwardly. For purpose of illustration and not limitation, as embodied herein, each panel portion (e.g. 41*a*, 41*b*) can taper from the carton base 50 corners outwardly ⅜ inches to a height of 1 and ½ inches with a 3/16 inches release cut on the carton fold score located at the top of each inwardly folding panel (e.g. 41). When folded or urged inwardly; the inwardly folding panels 41, 42, 43, 44 can also provide venting of air and moisture from the interior of the carton.

Any suitable combination of height, top tuck (e.g. lid or flap 20) shape, and optional condiment sauce holder (e.g. foldable supports) can be employed. Alternatives of the tapered container having a divider, a lid, two foldable supports, and four inwardly folding panels are described herein with reference to FIGS. 1-6. For example and not limitation, curved score top sides (which can provide additional carton height) can be combined with curved tapered top tuck flap (e.g. flap 20). Additionally, perforated tear down sides with additional side score can provide integrated (e.g. board usage) foldable supports in flaps 60 and 80, which can be used for example to hold an additional container, such as a sauce cup. Each container and corresponding blank 101-104 can have dual locking bottom tuck flaps to secure inner divider panel into a desired position, as described above.

The container and corresponding blank 105 can have the similar features as described above referring to 101-104, and can include an auto-bottom flap configuration, as described herein. The container and blank 106 can have the similar features as 105, and can include planar score side panels and a straight, downwardly tapering top tuck flap 20. The container and blank 107 can include an auto-bottom design with a uniform width bottom and straight across top tuck flap 20 having two foldable supports die cuts incorporated into extended flaps 60 and 80. A lid (e.g. main portion 21 of flap 20) can be contoured to hold the rims of an additional container, such as a sauce cup, when the cups are disposed therein and the container is in a closed position. Furthermore, the contour of the lid (e.g. main portion 21) can allow for venting through apertures of activated or unactivated die cut foldable supports.

Container and blank 108 can include an auto-bottom design single foldable support positioned in rear of top tuck flap (e.g. flap 20), and can have a straight downward tapering top tuck flap 20. Container and blank 109 can include similar features as 108, and can include curved score sides and curved downward tapering top tuck flap. Container and blank 110 can include similar features as 109, but without the foldable support in the flap 20. Container and blank 111 can include similar features as 109, but with two foldable supports formed in the rear of top straight tuck (e.g. flap 20) and additional score added at back edge of the foldable supports to allow flap 20 to be folded rearward to reduce the space needed, for example in a car cup holder, to hold the container. Container and blank 112 can have a similar curved score side panel/curved top tuck design to 105, and can include two foldable supports formed in the rear of top tuck flap 20. Container and blank 113 can have a similar straight downward tapered tuck design to 106, and can include two foldable supports formed in the rear of top tuck flap 20.

The disclosed subject matter includes divided containers sized to fit into a standard car cup holder and hold different products, including a "protein and starch" meal of portable "finger foods," such as fries/potato wedges and chicken nuggets, onion rings and "sliders", fish bites and chips, or the like.

It is to be recognized that the dimensions and relative proportions of the containers and corresponding blanks 101-113 will vary according to the application, desired capacity, and intended use of the food container or blank. While a food container formed by blanks 101-113 having a taper angle of 12 degrees is illustrated in FIGS. 1-26, one of ordinary skill will recognize that any suitable shape and depth of food container and corresponding blanks 101-113 can be employed and the disclosed subject matter is not so limited. Suitable shapes of containers include rectangles, triangles, cylinders, ovals, various polygons, etc., having any suitable dimensions.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A unitary blank for forming a food container comprising:

a first body portion having a first base edge at least partially defined by a first body portion base fold line, a second body portion joined to the first body portion by a first body fold line and having a second base edge at least partially defined by a second body portion base fold line, a third body portion joined to the second body portion by a second body fold line and having a third base edge at least partially defined by a third body portion base fold line, and a fourth body portion joined to the third body portion by a third body fold line and having a fourth base edge at least partially defined by a fourth body portion base fold line, at least two of such body portions each having a trapezoidal shape;

a first flap extending from the fourth body portion opposite the third body fold line and defined by a first flap fold line, the first flap having a first engagement portion adjacent to the fourth body portion and defined by a first flap engagement fold line, a second engagement portion opposite the fourth body portion and defined by a second flap engagement fold line, and a central portion defined between the first flap engagement fold line and the second flap engagement fold line, the first engagement portion disposed to engage the first body portion when the first flap is folded along the first flap line, the central portion disposed to form an interior dividing wall when the central portion is folded along the first flap engagement line, and the second engagement portion disposed to engage the third body portion when the second engagement portion is folded along the second flap engagement fold line;

at least one inwardly folding panel disposed between adjacent body portions along a corresponding body fold line; and a first base portion extending from the first body portion base edge, a second base portion extending from the second body portion base edge, a third base portion extending from the third body portion base edge, and a fourth base portion extending from the fourth body portion base edge, the second base portion and the fourth base portion each having an engagement feature disposed thereon, the base portions forming a base when joined together, wherein the at least one inwardly folding panel is disposed proximate the base.

2. The unitary blank of claim 1, further comprising a second flap extending from the second body portion opposite the second body portion base edge and defined by a second flap fold line, the second flap having a first foldable support formed therein, the first foldable support joined to the second flap by a first foldable support flap fold line and joined to the second body portion by a first foldable support body fold line.

3. The unitary blank of claim 2, further comprising a third flap extending from the fourth body portion opposite the fourth body portion base edge and defined by a third flap fold line, the third flap having a second foldable support formed therein, the second foldable support joined to the third flap by a second foldable support flap fold line and joined to the fourth body portion by a second foldable support body fold line.

4. The unitary blank of claim 1, further comprising a fourth flap extending from the first body portion opposite the first body portion base edge and defined by a fourth flap fold line, the fourth flap moveable between an open position and a closed position, the fourth flap including a tab to engage the third body portion when in the closed position.

5. The unitary blank of claim 4, the fourth flap having a foldable support formed therein, the foldable support joined to the fourth flap by a foldable support flap fold line and joined to the first body portion by a foldable support body fold line.

6. The unitary blank of claim 1, wherein the at least one inwardly folding panel comprises a plurality of inwardly folding panels, each disposed between adjacent body portions along corresponding body fold lines.

7. The unitary blank of claim 6, wherein the plurality of inwardly folding panels comprises a first inwardly folding panel disposed between the first body portion and the second body portion along the first body fold line, a second inwardly folding panel disposed between the second body portion and the third body portion along the second body fold line, a third inwardly folding panel disposed between the third body portion and the fourth body portion along the third body fold line, and a fourth inwardly folding panel disposed between the fourth body portion and the first body portion along the first flap fold line.

8. The unitary blank of claim 1, wherein the first base portion and the third base portion each have at least one perforation.

9. The unitary blank of claim 8, wherein the engagement features of the second base portion and the fourth base portion are disposed to be inserted into the perforations of the first and third base portions and to secure the central portion of the first flap.

10. The unitary blank of claim 1, wherein the at least one inwardly folding panel is at least one of:

(a) at least partially defined by a release cut at a top edge thereof;

(b) configured to provide venting of air and moisture from an interior of the food container;

(c) configured to extend from the base to a height less than a height of the body portions;

(d) provided with a first side portion and a second side portion separated by a fold line; or (e) tapered from the base to the top edge thereof.

11. A food container comprising:

a first body portion having a first base edge at least partially defined by a first body portion base fold line, a second body portion joined to the first body portion by a first body fold line and having a second base edge at least partially defined by a second body portion base fold line, a third body portion joined to the second body portion by a second body fold line and having a third base edge at least partially defined by a third body portion base fold line, and a fourth body portion joined to the third body portion by a third body fold line and having a fourth base edge at least partially defined by a fourth body portion base fold line, at least two of such body portions such having a trapezoidal shape;

a first flap extending from the fourth body portion opposite the third body fold line and defined by a first flap fold line, the first flap having a first engagement portion adjacent to the fourth body portion and defined by a first flap engagement fold line, a second engagement portion opposite the fourth body portion and defined by a second flap engagement fold line, and a central portion defined between the first flap engagement fold line and the second flap engagement fold line, the first engagement portion engaging the first body portion, the central portion forming an interior dividing wall, and the second engagement portion engaging the third body portion;

at least one inwardly folding panel disposed between adjacent body portions along a corresponding body fold line; and a first base portion extending from the first body portion base edge, a second base portion extending from the second body portion base edge, a third base portion extending from the third body portion base edge, and a fourth base portion extending from the fourth body portion base edge, the second base portion and the fourth base portion each having an engagement feature disposed thereon, the base portions forming a base, wherein the at least one inwardly folding panel is disposed proximate the base.

12. The food container of claim 11, further comprising a second flap extending from the second body portion opposite the second body portion base edge and defined by a second flap fold line, the second flap having a first foldable support formed therein, the first foldable support joined to the second flap by a first foldable support flap fold line and joined to the second body portion by a first foldable support body fold line.

13. The food container of claim 12, further comprising a third flap extending from the fourth body portion opposite the fourth body portion base edge and defined by a third flap fold line, the third flap having a second foldable support formed therein, the second foldable support joined to the third flap by a second foldable support flap fold line and joined to the fourth body portion by a second foldable support body fold line.

14. The food container of claim 11, further comprising a fourth flap extending from the first body portion opposite the first body portion base edge and defined by a fourth flap fold line, the fourth flap moveable between an open position and a closed position, the fourth flap including a tab to engage the third body portion when in the closed position.

15. The food container of claim 14, the fourth flap having a foldable support formed therein, the foldable support joined to the fourth flap by a foldable support flap fold line and joined to the first body portion by a foldable support body fold line.

16. The food container of claim 11, wherein the at least one inwardly folding panel comprises a plurality of inwardly folding panels, each disposed between adjacent body portions along corresponding body fold lines.

17. The food container of claim 16, wherein the plurality of inwardly folding panels comprises a first inwardly folding panel disposed between the first body portion and the second body portion along the first body fold line, a second inwardly folding panel disposed between the second body portion and the third body portion along the second body fold line, a third inwardly folding panel disposed between the third body portion and the fourth body portion along the third body fold line, and a fourth inwardly folding panel disposed between the fourth body portion and the first body portion along the first flap fold line.

18. The food container of claim 11, wherein the first base portion and the third base portion each have at least one perforation.

19. The food container of claim 18, wherein the engagement features of the second base portion and the fourth base portion are disposed to be inserted into the perforations of the first and third base portions and to secure the central portion of the first flap.

20. The food container of claim 11, wherein the at least one inwardly folding panel at least one of:

(a) at least partially defined by a release cut at a top edge thereof;

(b) configured to provide venting of air and moisture from an interior of the food container;

(c) configured to extend from the base to a height less than a height of the body portions;

(d) provided with a first side portion and a second side portion separated by a fold line; or (e) tapered from the base to the top edge thereof.

21. A unitary blank for forming a food container comprising:

a first body portion having a first base edge at least partially defined by a first body portion base fold line, a second body portion joined to the first body portion by a first body fold line and having a second base edge at least partially defined by a second body portion base fold line, a third body portion joined to the second body portion by a second body fold line and having a third base edge at least partially defined by a third body portion base fold line, and a fourth body portion joined to the third body portion by a third body fold line and having a fourth base edge at least partially defined by a fourth body portion base fold line, at least two of such body portions each having a trapezoidal shape;

a first flap extending from the fourth body portion opposite the third body fold line and defined by a first flap fold line, the first flap having a first engagement portion disposed to engage the first body portion when the first flap is folded along the first flap line;

at least one inwardly folding panel disposed between adjacent body portions along a corresponding body fold line; and a first base portion extending from the first body portion base edge, a second base portion extending from the second body portion base edge, a third base portion extending from the third body portion base edge, and a fourth base portion extending from the fourth body portion base edge, the second base portion and the fourth base portion each having an engagement feature disposed thereon, the base portions forming a base when joined together, wherein the at least one inwardly folding panel is disposed proximate the base.

22. The unitary blank of claim 21, wherein the at least one inwardly folding panel at least one of is at least partially defined by a release cut at a top edge thereof;

is configured to provide venting of air and moisture from an interior of the food container;

extends from the base to a height less than a height of the body portions;

has a first side portion and a second side portion separated by a fold line;

is tapered from the base to the top edge thereof; or comprises a plurality of inwardly folding panels, each disposed between adjacent body portions along corresponding body fold lines.

* * * * *